US007100743B2

(12) United States Patent
Park et al.

(10) Patent No.: US 7,100,743 B2
(45) Date of Patent: Sep. 5, 2006

(54) CRANK SHAFT IN DUAL CAPACITY COMPRESSOR

(75) Inventors: Kyoung Jun Park, Changwon-shi (KR); Kee Joo Kim, Changwon-shi (KR); Hee Hyun Kim, Changwon-shi (KR); Jong Bong Kim, Changwon-shi (KR); Young Joo Bae, Changwon-shi (KR); Cheol Ki No, Changwon-shi (KR); Jai Seong Sim, Masan-shi (KR); Min Young Seo, Changwon-shi (KR); Hyeon Kim, Changwon-shi (KR); Dal Soo Kang, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 511 days.

(21) Appl. No.: 10/468,114

(22) PCT Filed: Dec. 17, 2001

(86) PCT No.: PCT/KR01/02185

§ 371 (c)(1),
(2), (4) Date: Aug. 15, 2003

(87) PCT Pub. No.: WO03/052271

PCT Pub. Date: Jun. 26, 2003

(65) Prior Publication Data

US 2004/0241013 A1 Dec. 2, 2004

(51) Int. Cl.
*F01M 1/00* (2006.01)

(52) U.S. Cl. ..... 184/6.16; 415/88

(58) Field of Classification Search ..... 184/6.16; 415/88

See application file for complete search history.

(56) References Cited

U.S. PATENT DOCUMENTS

| | | | | | |
|---|---|---|---|---|---|
| 4,479,419 | A * | 10/1984 | Wolfe | 92/13.3 |
| 5,951,261 | A * | 9/1999 | Paczuski | 417/315 |
| 6,217,287 | B1 | 4/2001 | Monk et al. | |
| 6,619,926 | B1 * | 9/2003 | Manole et al. | 417/53 |
| 6,953,324 | B1 * | 10/2005 | Young et al. | 417/211 |
| 2003/0049136 | A1 * | 3/2003 | Manole et al. | 417/53 |
| 2004/0241013 | A1 * | 12/2004 | Park et al. | 417/313 |

FOREIGN PATENT DOCUMENTS

| | | |
|---|---|---|
| EP | 0587402 | 3/1994 |
| JP | 58025594 | 2/1983 |
| JP | 13-182656 | 7/2001 |

(Continued)

*Primary Examiner*—David Fenstermacher
(74) *Attorney, Agent, or Firm*—McKenna Long & Aldridge LLP

(57) ABSTRACT

A crankshaft in a dual capacity compressor is disclosed, which causes oil contained in a lower portion of the compressor to flow up to an upper portion thereof with respect to all the rotational directions of a motor. A crank shaft (100) includes a driving shaft (110) inserted into a reversible motor (21, 22) for rotating along with the motor (21, 22), a balance weight (120) formed in a top portion of the driving shaft (110) for preventing vibration during rotation from occurring, a crank pin (130) formed on an upper surface of the balance weight (120) to be eccentric from the center of the driving shaft (110), and a regular/reverse oil path (140) formed along the balance weight (120) and the crank pin (130) for moving oil for forward rotation and reverse rotation of the motor respectively. The crankshaft serves to stably lubricate each driving part of the dual capacity compressor regardless of rotation direction.

75 Claims, 23 Drawing Sheets

FOREIGN PATENT DOCUMENTS

JP 2001182656 7/2001

KR 2000-0038950 7/2000

* cited by examiner

CRANK SHAFT IN DUAL CAPACITY COMPRESSOR

TECHNICAL FIELD

The present invention relates to a compressor with a capacity varied with a rotation direction of a motor for compressing a working fluid, such as refrigerant to a pressure, and more particularly, to a crank shaft in a compressor having a structure for supplying lubricating oil to various driving parts during operation of the compressor.

BACKGROUND ART

In different apparatuses that require compression of a working fluid, particularly, in domestic appliances that employ a refrigerating cycle, such as refrigerators, a load on the appliance actually varies at all times, to require variation of a compression capacity of the compressor according to the variation of the load for improvement of an operation efficiency. To meet such a capacity variation requirement of the compressor, there have been different technical attempts, such as a variable rotation speed compressor, a multi-cylinder compressor, and the like. However, the technologies have many problems in putting into practical use of the technologies because of cost, and/or increased size of the compressor, instead of which a reciprocating type dual capacity compressor is developed by employing a simple mechanical structure. That is, the dual capacity compressor actually has two different compression capacities in respective rotation directions, i.e., a regular rotation direction (clockwise direction) and a reverse rotation direction (counter clockwise direction) by means of reversible motor and crankshaft, and a stroke varying structure in a crank pin region, of which the most general form is disclosed in U.S. Pat. No. 4,236,874.

The dual capacity compressor in the U.S. Pat. No. 4,236,874 is provided with a piston in a cylinder, a crankshaft, a crank pin having a center eccentric from a center of the crankshaft, an eccentric ring coupled with the crank pin, a connecting rod coupled both with the eccentric ring and the piston. The eccentric ring, and the connecting rod are rotatable with respect to adjoining components centered on the center of the crank pin. There is a length of release region in each of contact surfaces of the crank pin and the eccentric ring, between which a key is provided for coupling the crank pin and the eccentric ring, together. By using such a structure, the crankshaft rotates in a clockwise direction (regular rotation direction) when a heavy load is required, and the crankshaft rotates in a counter clockwise direction (reverse rotation direction) when a light load is required. That is, states of an eccentric ring arrangement differ in respective rotation directions, which in turn vary the piston stroke, to provide maximum stroke Lmax and compression capacity in the regular rotation direction when the eccentricity is the greatest, and minimum stroke Lmin and compression capacity in the reverse rotation direction when the eccentricity is the smallest.

Since moving parts, such as the motor/crankshaft, the piston, and the connecting rod, move at comparatively high speeds, an appropriate lubrication, and a lubricating system for the appropriate lubrication are required for the moving parts commonly for smooth operation of the compressor. In the reciprocating type compressor, the lubricating oil is held in a bottom of the compressor, and the crankshaft moves the lubricating oil upward along an oil passage therein and supplies to required moving parts by a centrifugal force of the crankshaft and a viscosity of the lubricating oil itself. However, if a lubricating oil system of a related art reciprocating type compressor, in which a centrifugal force is utilized mostly, is applied to the dual capacity compressor, lubricating performances may be varied with the rotation directions. Accordingly, though a lubrication oil system optimized to respective rotation directions is actually required, the U.S. Pat. No. 4,236,874 fails to teach such a lubrication oil system.

In the meantime, other than the U.S. Pat. No. 4,236,874, there are many patents that disclose technologies related to the dual capacity compressor, which will be described, briefly.

Similarly, U.S. Pat. No. 4,479,419 discloses a dual capacity compressor that employs a crank pin, an eccentric cam, and a key. The key is fixed to the eccentric cam, and moves along a rail on the crank pin when a rotation direction of the compressor is changed.

Also, in a compressor disclosed in U.S. Pat. No. 5,951,261, a bore of a fixed inside diameter is formed in an eccentric part, and a bore with an inside diameter the same with the bore in the eccentric part is formed at one side of an eccentric cam. A pin is provided to the bore in the eccentric part, and a compression spring is provided to the bore in the eccentric cam, so that the pin moves into the bore in the cam by a centrifugal force when respective bores are aligned during rotation, for restriction of the eccentric part and the eccentric cam.

However, not only the foregoing patents, but also other related patents, disclose the stroke varying structure of the dual capacity compressor, but fail to disclose an appropriate lubricating oil system.

DISCLOSURE OF THE INVENTION

Accordingly, the present invention is directed to a crankshaft of a dual compressor that substantially obviates one or more of the problems due to limitations and disadvantages of the related art.

An object of the present invention is to provide a crankshaft of a dual capacity compressor, which can make stable lubricating oil supply both in regular and reverse direction rotation intended for change of a compression capacity.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

For achieving the foregoing objects of the present invention, above all, the applicant thinks a lubricating oil system is required, that serves for a regular direction rotation and a reverse direction rotation, i.e., making the lubrication oil to flow, separately. Accordingly, the applicant devised various workable oil flow systems, and carried out experiments for all the systems. As a result of the experiments, most of the devised oil flow systems exhibit stable oil flows, and the following structures are fixed taking unit production cost and productivity into account.

To achieve these and other advantages and in accordance with the purpose of the present invention, as embodied and broadly described, the crankshaft in a dual capacity compressor includes a driving shaft inserted in a reversible motor for rotation in a direction the same with the motor together with the motor, a balance weight on a top end of the driving shaft for prevention of vibration during rotation, a crank pin on a top surface of the balance weight eccentric from a center of the driving shaft connected to a connecting rod on a piston through an eccentricity adjusting member, and a regular rotation and reverse rotation oil passage formed along the driving shaft, the balance weight, and the crank pin for individual oil flow both for regular direction rotation and reverse direction rotation of the motor, thereby transmitting a regular direction rotation force or a reverse direction rotation force of the motor to a coupled driving members for compressing refrigerant according to a compression capacity varied with rotation direction, and making a stable oil supply to required driving parts through the regular rotation and reverse rotation oil passage regardless of a motor rotation direction.

According to a form of the crankshaft, the regular rotation and reverse rotation oil passage includes a shaft oil hole extended from a bottom end of the driving shaft to a height in a longitudinal direction through an inside of the driving shaft, at least one straight oil groove in communication with the shaft oil hole extended to a length in an outer circumferential surface of the driving shaft, and a pin oil hole in communication with the oil groove extended up to a top part of the crank pin through insides of the balance weight, and the crank pin.

The oil groove may be single straight groove for flowing oil regardless of a rotation direction of the motor, or includes two straight grooves for flowing oil regardless of a rotation direction of the motor.

In more detail, it is preferable that the oil groove is formed in the outer circumferential surface of the driving shaft offset at an angle from an axis of the crank pin in a clockwise or counter clockwise direction, and is formed to have a lower end at a height from a lower end of the journal of the driving shaft.

In consideration of wear suppression and formability of the crankshaft, the offset angle is required to be maximum 40°, the height is minimum 5 mm. The offset angle optimum for wear suppression of the crankshaft is 22°–33°, and the height optimum for wear suppression of the crankshaft is 10 mm–12 mm.

The offset angle both for wear suppression of the crankshaft and an oil supply rate is preferably 20°–40° and the height optimum both for wear suppression of the crankshaft and an oil supply rate is preferably 7 mm–15 mm, and the offset angle both for wear suppression of the crankshaft and an oil supply rate is more preferably 30±5° and the height both for wear suppression of the crankshaft and an oil supply rate is more preferably 10±2 mm.

Preferably, the oil groove has a width below 3 mm for suppression of wear of the crankshaft, and a depth deeper than 2.5 mm for compensating a flow rate reduction caused by the width.

The oil groove is single straight groove inclusive of a partial helical groove continuous from an upper part of the straight groove.

Preferably, the partial helical groove serves for oil supply for a rotation direction in which the crankshaft generates a heavy load, and the oil groove has an upper end and a lower end offset at an angle 10°–30°.

The oil groove further includes at least one supplementary oil groove in a lower part of the journal of the driving shaft for supplying oil to a lower part of a radial bearing in communication with a recessed part in a central part of the journal, and extended to a location in the vicinity of a lower end of the journal.

For suppression of wear, the supplementary oil groove preferably has a width below 2 mm, and a lower end located higher than the lower end of the journal of the driving shaft by more than 3 mm. The supplementary oil groove is preferably offset from the oil groove at an angle greater than 90° on the driving shaft, and a straight groove, or a helical groove.

When there are two oil grooves, the pin oil hole may include a single common hole connected to the two oil grooves, or two independent holes connected to the two oil grooves individually. Also, the shaft oil hole may include a single common hole connected to the two oil grooves, or two independent holes connected to the two oil grooves, individually.

According to another form of the crankshaft, the regular rotation and reverse rotation oil passage includes, a shaft oil bole extended from a bottom end of the driving shaft to a height in a longitudinal direction through an inside of the driving shaft, at least one helical oil groove in communication with the shaft oil hole extended upward to a length along an outer circumferential surface of the driving shaft, and a pin oil hole in communication with the oil groove extended up to a top part of the crank pin through insides of the balance weight, and the crank pin.

The oil groove includes two helical grooves each for independent oil flow for one of rotation directions of the motor, and preferably the helical groove for oil flow during the regular rotation has a length longer than the helical groove for oil flow during the reverse rotation.

The oil groove includes a helical groove for oil flow during one of rotation directions of the motor, and a straight groove for oil flow regardless of the rotation directions of the motor, and preferably the helical groove serves for oil flow for a rotation direction in which the crankshaft generates a great load.

Preferably, the oil grooves do not cross in the outer circumferential surface of the driving shaft, and are not connected at upper ends thereof to each other.

If there are two oil groove, the pin oil hole includes one common hole connected to the two oil grooves, or two independent holes connected to two oil grooves individually, and the shaft oil hole includes one common hole connected to the two oil grooves, or two independent holes connected to two oil grooves individually.

According to a further form of the crankshaft, the regular rotation and reverse rotation oil passage includes at least one shaft oil hole extended from a bottom end of the driving shaft to a location in the vicinity of the crank pin in a longitudinal direction through an inside of the driving shaft, a pin oil hole directly connected to the pin oil hole, and extended from a top end of the shaft oil hole up to a top part of the crank pin through insides of the balance weight, and the crank pin, and at least one oil groove in communication with the shaft oil hole, or the pin oil hole, and extended upward in an cater circumferential surface of the driving shaft.

The shaft oil hole includes one, or two eccentric holes with respect to the axis of the driving shaft, or a coaxial hole with respect to an axis of the driving shaft.

The oil groove may be single helical groove having an upper end and a lower end connected to the shaft oil hole respectively, preferably not aligned on the same straight line. Also, the single helical groove preferably serves for oil flow for a rotation direction the crankshaft generates a great load.

The oil groove includes two helical grooves extended in opposite directions.

Of the two helical grooves, each of the helical grooves preferably includes a lower end connected with the shaft oil hole and an upper end closed to the shaft oil hole, or more preferably includes upper ends and lower ends connected to each other, respectively. Also, the helical grooves preferably do not cross each other in the outer circumferential surface of the driving shaft.

The oil groove includes one or two straight grooves for oil flow regardless of the rotation direction of the motor, and preferably each of the straight grooves includes a lower end connected to the shaft oil hole, and an upper end closed to the shaft oil hole.

The pin oil hole includes a single common hole or two independent holes with respect to the shaft oil hole.

Thus, the crankshaft of the present invention permits oil flow both for regular and reverse rotation, for stable supply of oil to various driving parts.

It is to be understood that both the foregoing general description and the following detailed description are exemplary and explanatory and are intended to provide further explanation of the invention as claimed.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Reference will now be made in detail to the preferred embodiments of the present invention, examples of which are illustrated in the accompanying drawings. In explaining the present invention, same parts will be given identical names and reference symbols, and additional explanations of which will be omitted. An entire system of the dual capacity compressor having the crankshaft of the present invention applied thereto will be explained with reference to FIG. 1.

Figure 1:
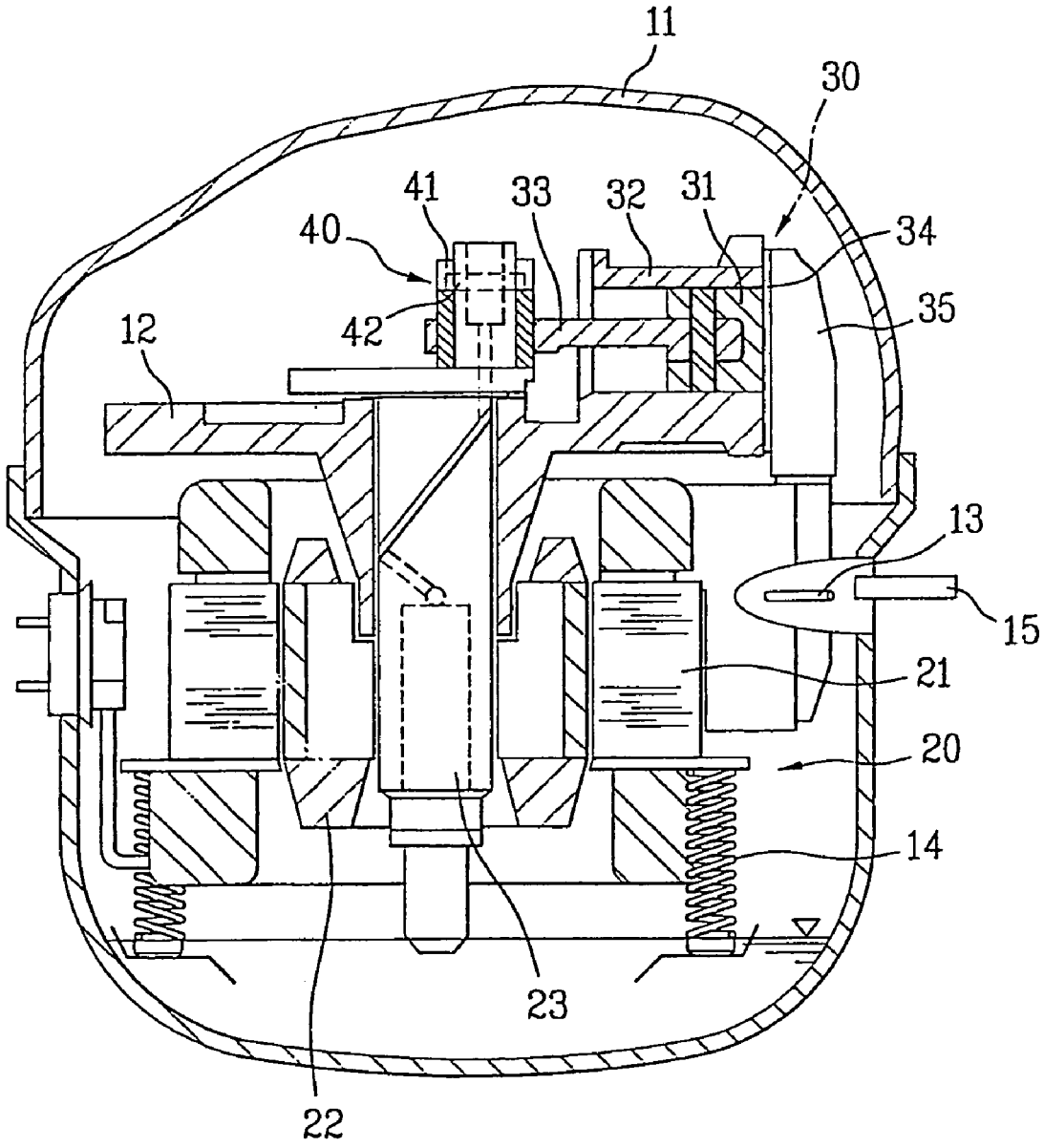
FIG. 1 illustrates a section of a related dual capacity compressor.

Referring to FIG. 1, the dual capacity compressor includes a power generation part 20 in a lower part of the compressor for generating and transmission of a required power, and a compression part 30 over the power generation part 20 for compression of a working fluid by the supplied power. Along with this conventional system, there is a stroke varying part 40 connected between the power generation part 20 and the compression part 30, for varying a compression capacity of the compression part 30 during operation. In the meantime, the shell 11 encloses the power generation part 20 and the compression part 30, and has a frame 12 elastically supported on a plurality of supporting members (for an example, a spring) 14 fixed to the shell and supporting the power generation part 20 and the compression part 30. There is a refrigerant inlet tube 13, and a refrigerant outlet tube 15 fitted to the shell 11 in communication with an inner part of the shell 11.

The compression part 30 is over the power generation part 20, supported on the frame 12, and includes a driving mechanism for making mechanical movement to compress the refrigerant, and a suction and a discharge valve structures for assisting the driving mechanism. Along with the cylinder 32 that forms an actual compression space, the driving mechanism includes a piston 31 for making reciprocating motion in the cylinder 32 to draw and compress the refrigerant, and a connecting rod 33 for transmission of a reciprocating power to the piston 31. The valve structures receive the refrigerant for the cylinder 32, or discharge compressed refrigerant in combination with related components, such as the cylinder head 34 and the head cover 35.

Though not shown in detail, the stroke varying part 40 may include an eccentric member 41 rotatably fitted between an outer circumference of the crank pin and the connecting rod 33, and a fixing member 42 for fixing the eccentric member 41 with respect to one of the rotation directions of the compressor. This system re-arranges the eccentric sleeve according to the rotation direction (regular or reverse) of the motor, to vary a compression capacity according to variation of an effective eccentricity and piston displacement. Though this stroke varying part 40 is disclosed in an international application No. PCT/KR01/0094 filed by the applicant, any variation of the stroke varying part 40 that varies a stroke depending on the rotation direction other than the foregoing system can be employed.

Lastly, the power generation part 20 is mounted under the frame 12, and includes a motor having a stator 21 and a rotor 22 for generating a rotation force by an external power source, and a crankshaft 23 fitted through the frame 12. The motor is rotatable in clockwise direction, or counter clockwise direction. The crankshaft 23 transmits regular, or reversible direction rotation of the motor to the compression part 30, basically.

Moreover, in the present Invention, the crankshaft 23 has a structure in which the lubricating oil can flow in both rotation directions of the motor, thereby allowing to supply the lubricating oil held in the bottom of the compressor to required moving parts regardless of the rotation direction of the motor.

Since the power generation part and the compression part in the dual capacity compressor of the present invention are identical to a general compressor, or not limited to particular systems, additional explanations of the power generation part and the compression part will be omitted. The crankshaft of the present invention explained briefly will be explained in more detail in the following first to third embodiments.

FIRST EMBODIMENT

Figure 2:
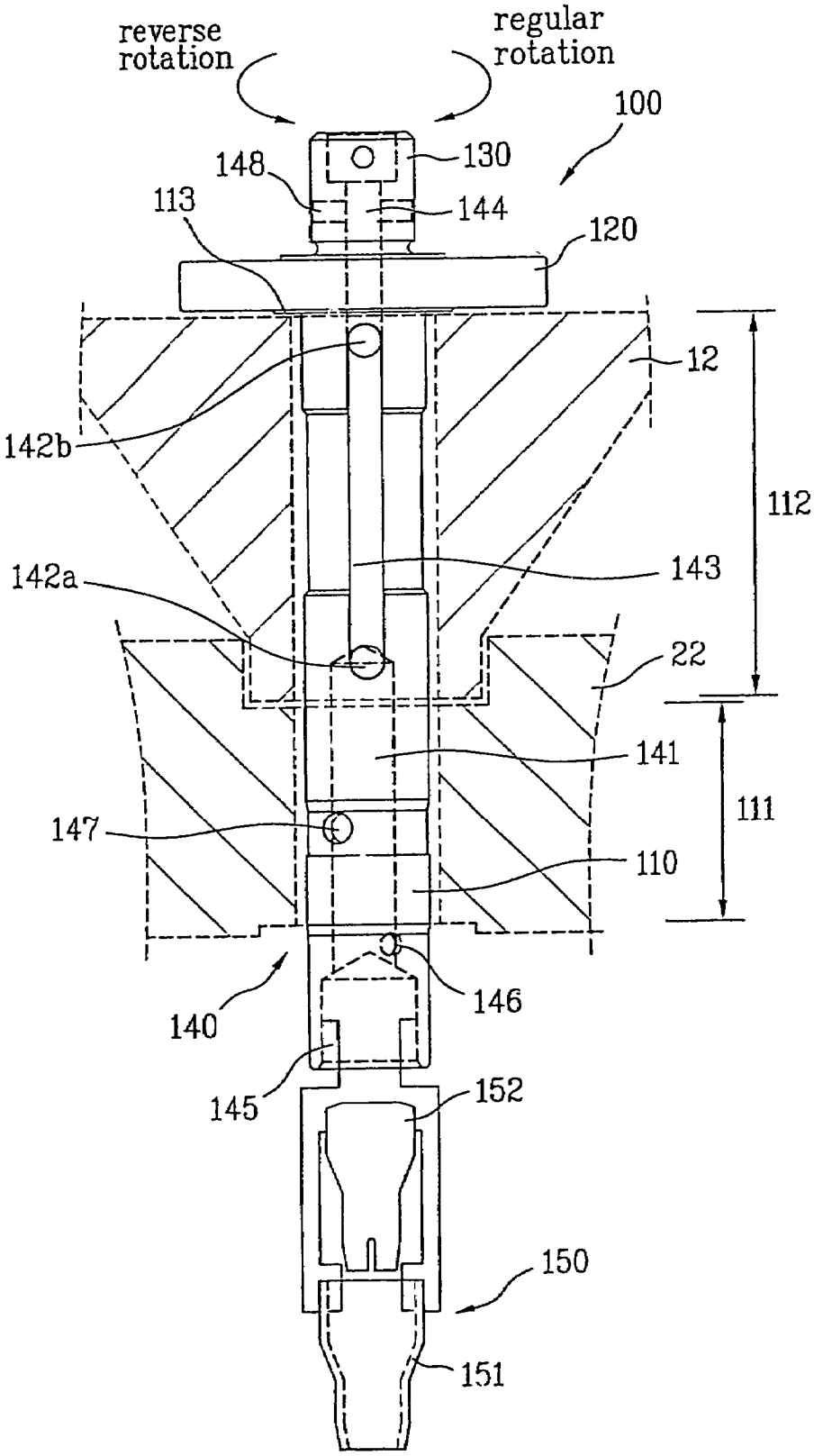
FIG. 2 illustrates a front view of a crankshaft of a dual capacity compressor in accordance with a first preferred embodiment of the present invention.
Figure 3:
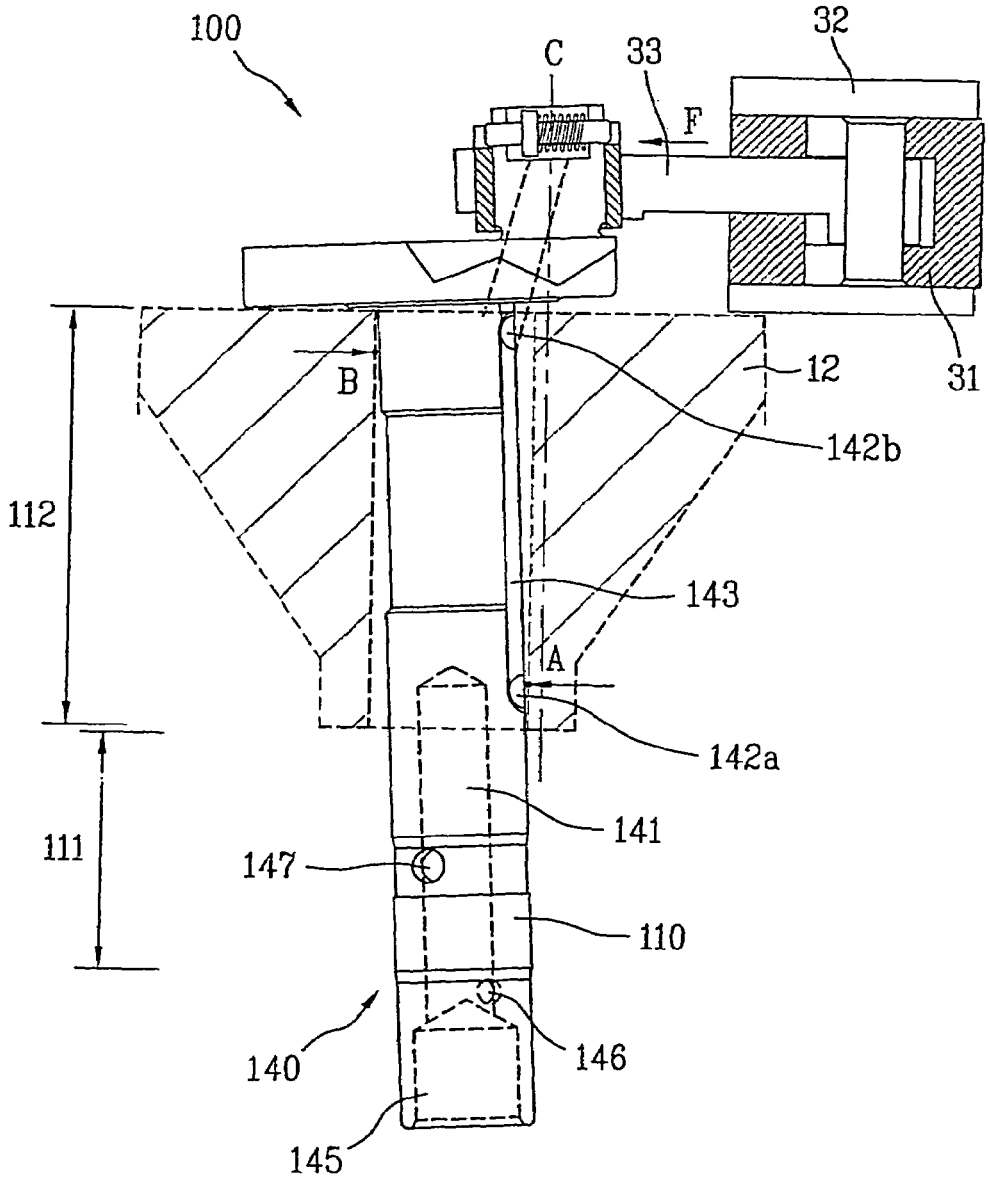
FIG. 3 illustrates a side view showing a state of the crankshaft in FIG. 2 when a pressure inside of a cylinder is transmitted to the crankshaft at a top dead center.
Figure 4A:
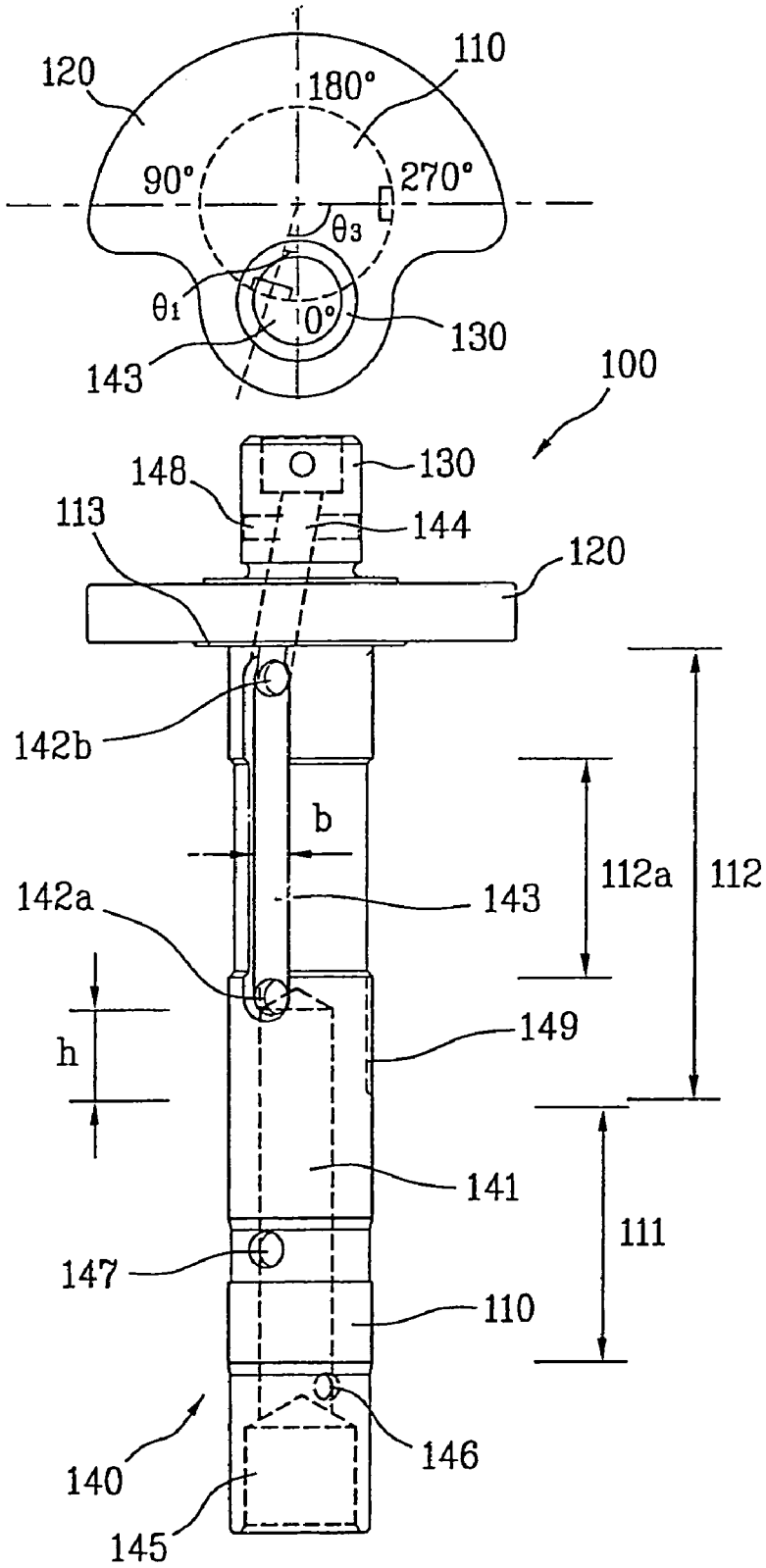
FIGS. 4A and 4B illustrate front and plan views of a variation of the crankshaft in accordance with a first preferred embodiment of the present invention, respectively.
Figure 4B:
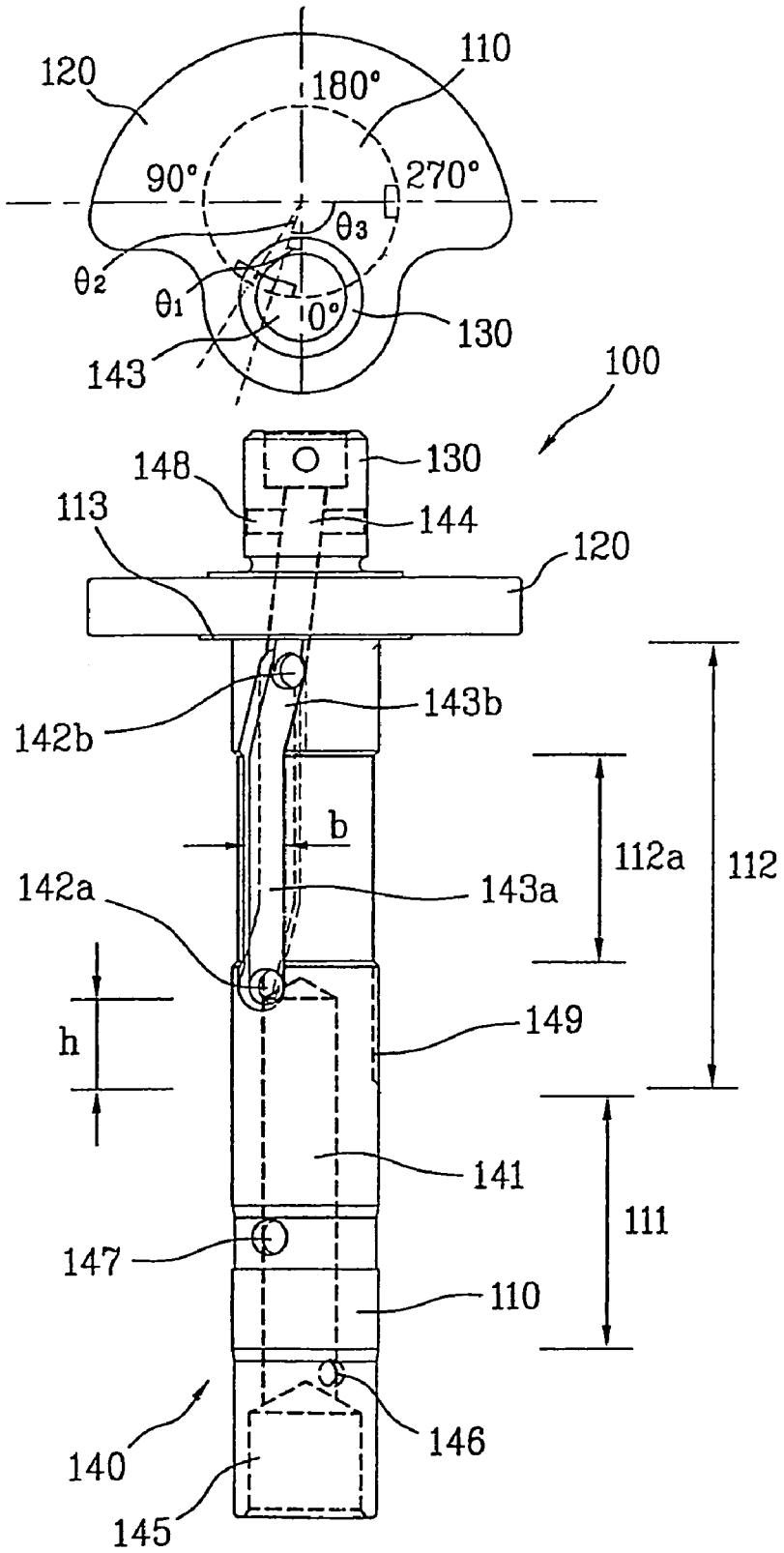
Figure 5:
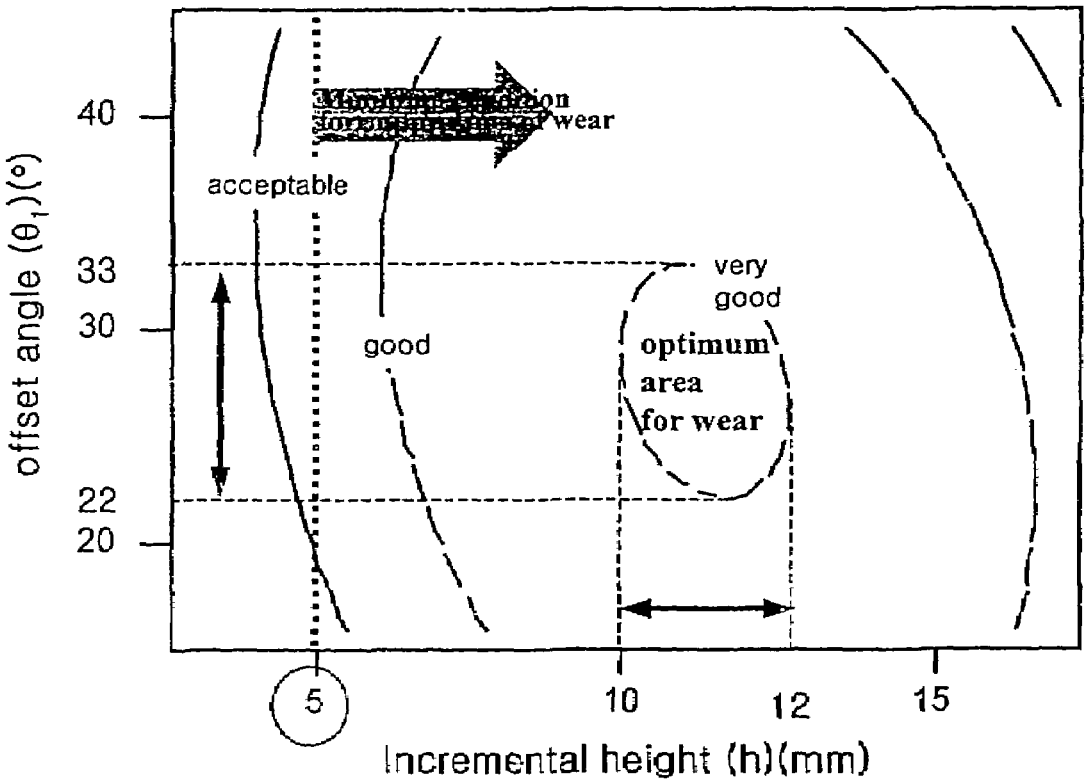
FIG. 5 illustrates a graph showing wear in relation to an offset angle and an incremental height of an oil groove.

FIGS. 2 and 3 illustrate a crankshaft in a dual capacity compressor in accordance with a first preferred embodiment of the present invention, and FIGS. 4 to 6 illustrate variations of the crankshaft in the first embodiment, referring to which the first embodiment will be explained in detail.

Referring to FIG. 2, the crankshaft 100 in a dual capacity compressor includes a driving shaft 110 in a reversible motor, a balance weight 120 at an upper end of the driving shaft 110, and a crank pin 130 on an upper surface of the balance weight. The crankshaft 100 has a regular and reverse direction rotation oil passage 140 formed along the driving shaft 110, the balance weight 120, and the crank pin 130.

The driving shaft 110 has a fitting part 111 in a lower part thereof for inserting the rotor 22 for direct transmission of the motor rotation. For stable transmission of the motor rotation up to the piston 31, there is a journal 112 inserted in the frame 12 to form a radial (journal) bearing, to support a load perpendicular to a center axis. The collar 113 forms a thrust bearing in combination with the upper surface of the frame 12, to support an axial direction load during operation. The journal is in a region started from an upper side of the fitting part 111 to an upper end of the driving shaft 110, and the collar 113 is formed on the balance weight around the driving shaft 110, for preventing vibration during rotation. The crank pin 130 is formed eccentric from a center of the driving shaft 110, and connected to an eccentricity adjusting member 41, and the connecting rod 33 at the piston 31.

As the driving shaft 110, balance weight 120, and etc., in the first embodiment crankshaft 100 is the same with a general crankshaft, explanation of the crankshaft 100 will be omitted, and a regular/reverse rotation oil passage 140 will be explained in detail.

The first embodiment regular/reverse rotation oil passage 140 permits the oil to flow both in a regular rotation (clockwise rotation) and a reverse rotation (counter clockwise rotation) of the motor made for obtaining different compression capacities. To do this, the, oil passage 140 includes a shaft oil hole 141 in a lower part 110 of the driving shaft, at least one oil groove 143 in communication with the shaft oil hole 141 formed in an upper part of the driving shaft 110, and a pin oil hole 144 in communication with the oil groove 143 formed in the crank pin 130. That is, the shaft oil hole 141, the oil groove 143, and the pin oil hole 144 form a continuous oil passage throughout the crankshaft 100.

The shaft oil hole 141 is extended starting from a bottom end of the driving shaft 110 to a height of the driving shaft 10 parallel to an axis, and inside of the driving shaft 10. That is, the shaft oil hole 141 is opened to exterior at the bottom end of the driving shaft 110, and extended until the shaft oil hole 141 is connected to the oil groove 143. Also, there is a pump seat 145 in a lower end part of the shaft oil hole 141 for receiving an oil pump 150. The oil pump 150 is a kind of centrifugal pump having a hollow body 151 and a propeller 152 inserted in the body 151. The oil pump 150 fitted to the seat 145 is submerged in the oil in the bottom of the compressor, so that the oil can be introduced to the shaft oil hole 145 through the oil pump 150 at first. The shaft oil hole 141 has a gas hole 146 and a sediment hole 147, both in communication therewith, for assisting smooth oil flow. The gas hole 146 is just below the rotor 22 fitting part 111 for discharge of gas in the flowing oil. The sediment oil 147 is in the rotor fitting part 111 for discharge of contaminant in the oil.

The oil groove 143 is in communication with the shaft oil hole 141 and the pin oil hole 144 through upper and lower connection holes **142*b* and 142*a* at an upper end and a lower end thereof, respectively. That is, in order to form one continuous oil passage (the oil passage of the present invention) through which the oil moves from the bottom of the compressor to the compression part 30 in the upper part of the compressor, the oil groove 143 connects the shaft oil hole 143 to the pin oil hole 144. As the oil groove 143 serves for feeding oil to a radial bearing (between the journal 112 and the frame 12) and the thrust bearing (between the collar 113 and the frame 12), the oil groove 143 is formed throughout the journal substantially, an upper part of which is enclosed by an inside wall of the frame 12** to form a flowing space.

In the first embodiment of the present invention, the oil groove 143 is a single straight groove, actually. The oil groove 143 is in general helical, for adequate supply of oil as the helical groove enlarges the flow passage. However, the helical groove permits an oil flow for one direction of rotation of the crankshaft due to its geometrical characteristic. That is, the helical oil groove can make the oil to move upward only when the helical oil groove is formed in a direction opposite to the rotation direction of the driving shaft 110. Different from such a helical groove, a straight groove is not influenced from such a geometrical characteristic, to move the oil upward up to the pin oil hole 144 regardless of the direction of rotation of the shaft by a centrifugal force generated when the shaft is rotated.

In the meantime, referring to FIG. 3, a pressure of the gas compressed to the maximum in the cylinder 32 just before the piston 31 moves toward a bottom dead center after the piston 31 reaches to a top dead center is applied to the crank pin 130 through the connecting rod 33, momentarily. Though somewhat exaggerated, the crankshaft 100 is tilted, and rotated irregularly within the frame 12 due to the gas pressure, momentarily. In more detail, when the crankshaft 100 is tilted during rotation, the driving shaft 10 has reaction forces thereon from an oil film and/or the frame 12 at 'A' and 'B' points, and, when the crankshaft 100 is tilted extremely, the driving shaft 110 comes into contact with the frame 12 at 'A' and 'B' points. Moreover, in view of characteristics of the radial bearing, the radial bearing has oil films formed relatively uneven in a circumferential direction at both ends inclusive of 'A' and 'B' points compared to a central part. On the other hand, the straight groove 143 breaks a circumferential surface of the driving shaft 110 continuously in a longitudinal direction on a straight line, to form a gap between the frame 12 and the driving shaft 110 greater than other parts compared to the helical groove, inhibiting formation of an adequate oil film in the vicinity of the straight groove compared to the helical groove, in overall. Eventually, as shown in FIG. 3, the straight groove formed parallel to the axis 'C' of the crank pin in the driving shaft 110 causes an increased wear at the end in the vicinity of 'A' point.

Taking the foregoing conditions into account, referring to FIG. 4A, with regard to a location of formation of the straight oil groove, it is preferable that the location offsets to left (clockwise direction) or right (counter clockwise direction) from a reference position parallel to an axis 'C' of the crank pin 130 (i.e., a common plane of the axis 'C' and the axis of the driving shaft) at an angle θ1. The setting of the offset angle θ1 prevents the lower end and the vicinity thereof of the oil groove 143 (hereafter called as a wear down region) from coming into direct contact with the frame, to suppress wear. Moreover, as described before, the wear down region by the straight oil groove 143 is caused, not only by contact with the frame 12, but also the unstable oil film in the vicinity of the end of the bearing. Therefore, it is preferable that the wear down region (the lower end of the straight oil groove 143) is provided above the lower end of the journal 112, which is an original location, by an incremental height 'h' so that the wear down region is provided away from the oil film unstable region. The incremental height 'h' brings the wear down region into an oil film stable region, to suppress the wear.

Figure 6A:
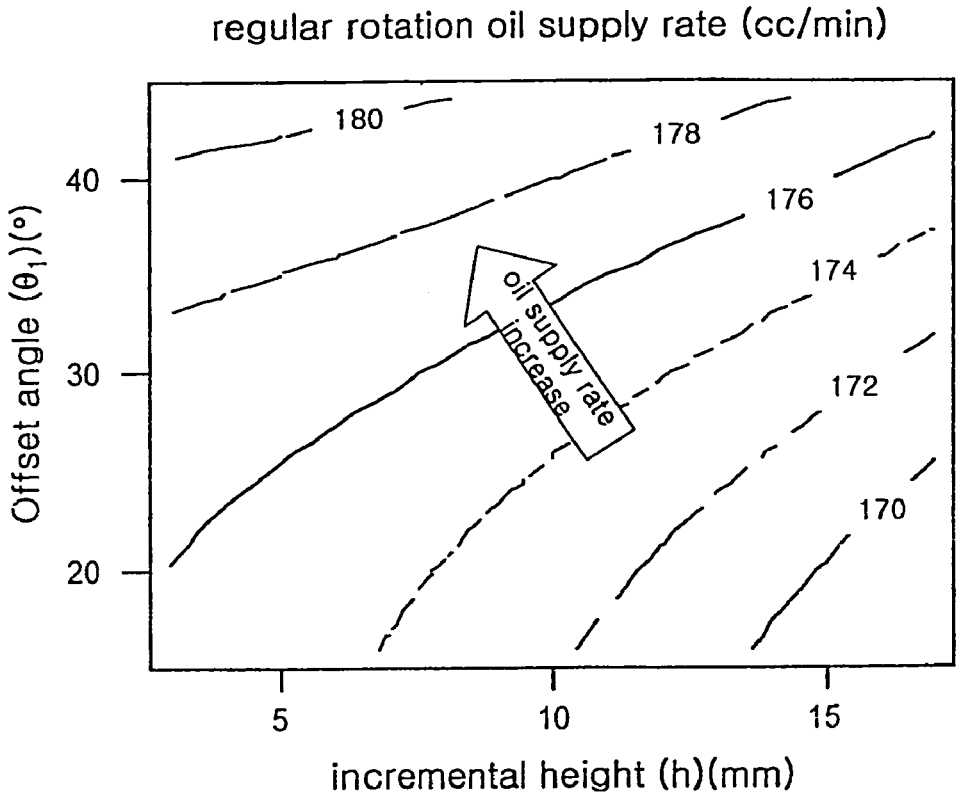
FIG. 6A and 6B illustrate graphs each showing lubricating oil supply in relation to an offset angle and an incremental height of an oil groove.
Figure 6B:
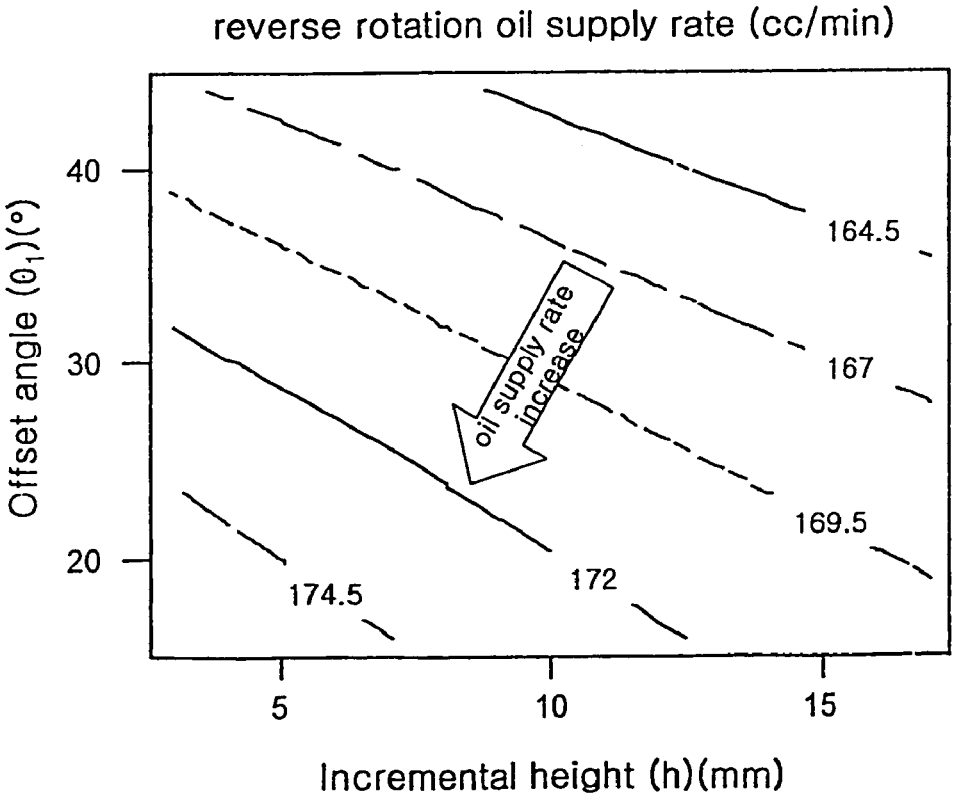
Figure 7:
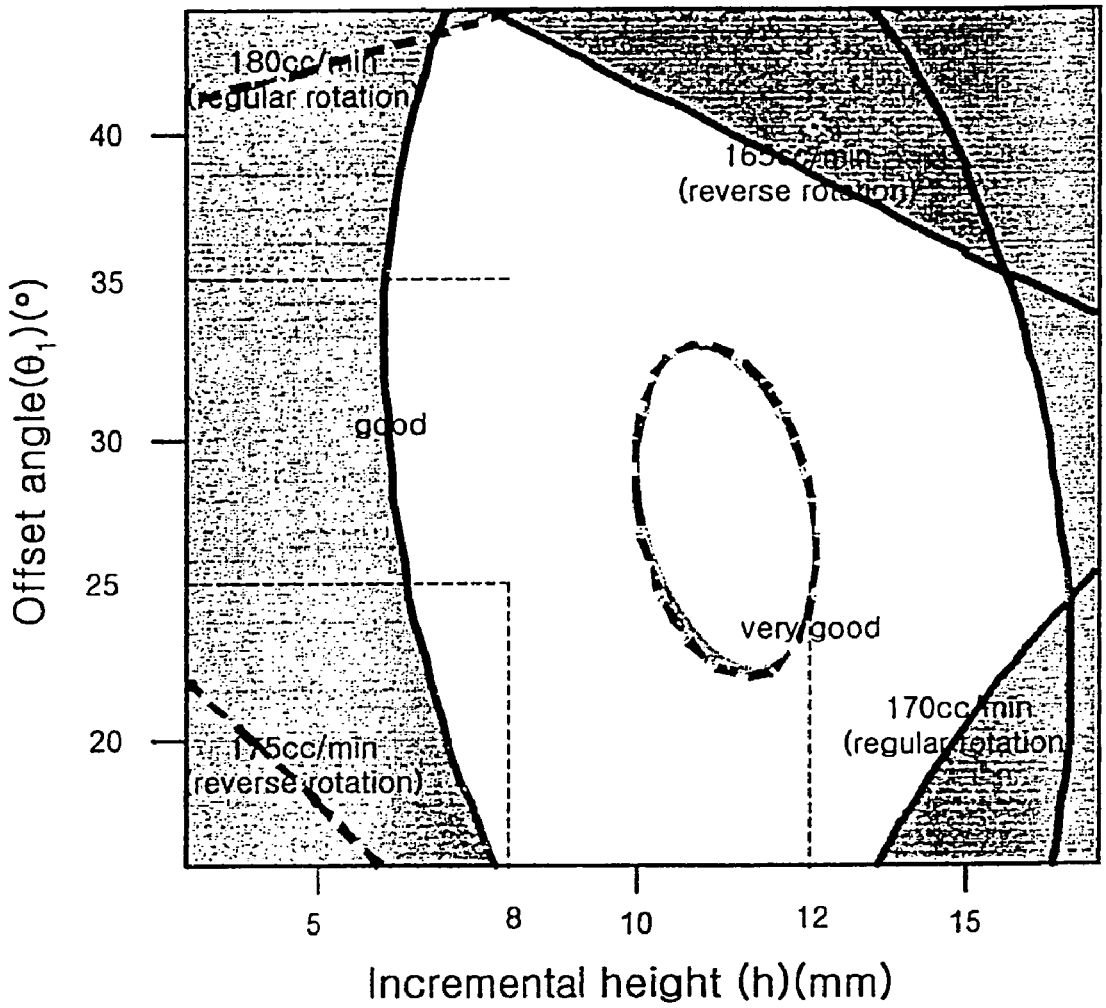
FIG. 7 illustrates a graph showing the wear in FIG. 5, and the lubricating oil supply in FIGS. 6A and 6B in relation to the offset angle and the incremental height of an oil groove, respectively.

The offset angle θ1 and the incremental height 'h' are optimized through actual experiments, and FIGS. 5–7 illustrate results of the experiments taken into account for calculation of optimum values for respective cases.

FIG. 5 illustrates a graph showing wear in relation to an offset angle and an incremental height of an oil groove. In the experiment, width and depth of the oil groove 143 are fixed as the width and depth give great influences to wear. In measurement of the offset angle θ1, the reference position of the driving shaft 110 is set to 0°, and an angle increased in the clockwise direction is set to be a positive angle. The incremental height 'h' is from the lower end of the journal 112 to a lower end of an actual oil groove 143. The wear is results of visual inspection of the wear down regions on a plurality of test pieces (crankshafts), each of which is fabricated according to preset offset angle θ1, and incremental height 'h', fitted to the compressor, run for three hours in regular and reverse rotation direction, total six hours (ASHRAE condition).

Referring to FIG. 5, it is appeared that the wear is more sensitive to the incremental height 'h' than the offset angle θ1 when contour of wear degrees (very good, good, acceptable) is taken into consideration. Therefore, though it is difficult to define an appropriate condition for suppression of the wear with reference to he offset angle θ1 explicitly based on the experimental result, it can be known that the appropriate condition for suppression of the wear with reference to the incremental height 'h' is greater than at least 5 mm. However, it is preferable that the offset angle θ1 is set to be within a range below 40° at the maximum as an excessively great offset angle θ1 may make formation of the pin oil hole 144 to be in communication with the straight oil groove 143 difficult. Different from this, an optimal condition for suppression of the wear is shown in a central part of the drawing clearly as a very good degree region, where the offset angle θ1 is 22~23°, and the incremental height 'h' is 10 mm–12 mm.

In the meantime, even if the foregoing optimum condition suppresses the wear, the offset angle θ1 and the incremental height 'h' may affect an oil supply rate that is the most important performance. Therefore, referring to FIGS. 6A and 6B, variation of the oil supply rate with respect to the offset angle θ1 and the incremental height 'h' is taken into account in regular and reverse direction rotation based on experiments. In FIGS. 6A and 6B, references for the width and depth of the oil groove 143, the offset angle θ1, and the incremental height 'h' are the same with the experiments of wear down degree associated with FIG. 5, and the oil supply rate is in unit of cc/min supplied through the crankshaft.

In a case of regular direction rotation in FIG. 6A, the oil supply rate has an increasing trend as the incremental height 'h' becomes the lower and the offset angle θ1 becomes the greater, and, in a case of reverse direction rotation in FIG. 6B, the oil supply rate has an increasing trend as the incremental height 'h' becomes the lower and the offset angle θ1 becomes the smaller. In other words, a positive offset angle θ1 (a clockwise direction angle from the reference angle 0°) is favorable for the oil supply during the regular direction rotation, and a negative offset angle θ1 is favorable for the oil supply during the reverse direction rotation. However, a variation of the oil supply rates (a difference between upper and lower bounds) exhibited in each of the regular and reverse direction rotation is no more than in an order of approx. 10 cc/min, with approx. 5 cc/min difference between the upper bound or lower bound of respective direction rotation (an upper bound and a lower bound in the regular direction rotation: 180 cc/min, and 170 cc/min, and an upper bound and a lower bound in the reverse direction rotation: 174.5 cc/min, and 164.5 cc/min). Also, both the upper bound and the lower bound of the oil supply rate are higher than an actual required oil supply rate. Therefore, different from the case of wear suppression, it can be known that, though the oil supply rate is influenced from the offset angle θ1 and the incremental height 'h' on the whole, the offset angle θ1 and the incremental height 'h' have no decisive role in the variation of the oil supply rate.

In order to find a condition in which both the offset angle θ1 and the incremental height 'h' are taken into account based on the foregoing results of experiment, the relation of the degrees of wear to the offset angle θ1 and the incremental height 'h' shown in FIG. 5, and the relation of the oil supply rate to the offset angle θ1 and the incremental height 'h' shown in FIGS. 6A and 6B, are compared in FIG. 7.

In more detail, an area between the upper bound and the lower bound of the oil supply rate and an area of good wear states in the regular and reverse direction rotation overlap in FIG. 7. Therefore, a white area shown in FIG. 7 is an area satisfying both the oil supply standard in the regular/reverse direction rotation and the wear down standard, which substantially falls on ranges of the offset angle θ1 of 20°–40°, and the incremental height 'h' of 7 mm–15 mm. As far as there are no other factors, since a shadowed area shown in FIG. 7 in a central part of the white area, the shadowed area can be determined to be an area meeting optimum conditions of the wear and the oil supply rate. The shadowed area falls on ranges of the offset angle θ1 of 30±5°, and the incremental height 'h' of 10±2 mm.

In addition to optimization of the offset angle θ1 and the incremental height 'h', for reducing a circumferential damage to the driving shaft 110 that inhibits formation of the oil film, the width 'b' of the straight oil groove 143 is required to be minimized as far as possible. Based on a result of separate experiments for this, it is preferable that the width 'b' is below 3 mm in the crankshaft in general compressor. The reduction of oil supply rate caused by the width reduction can be compensated by an increased depth of the oil groove 143, resulting to the depth of the oil groove greater than 2.5 mm.

Moreover, as shown in FIG. 4B, the oil groove may include a partial helical groove 143*b* for avoiding the continuous straight line breakage of the circumferential surface of the driving shaft 110. That is, the oil groove 143 mar include a straight groove 143*a* and a helical groove 143*b* continuous from the straight groove 143*a*

In this instance, the oil groove 143 may include a lower straight groove 143*a* and an upper helical groove 143*b* shown in solid lines, or, opposite to this, an upper straight groove and a lower helical groove shown in dashed lines. With regard to the two forms of the oil grooves, a combination of the lower straight groove 143*a* and the upper helical groove 143*b* is preferable, because the combination can initiate oil flow in the oil groove regardless of the rotation direction. Moreover, depending on a direction of the helix of the helical groove 143*b*, the oil supply rate increases in any one of the regular, and reverse directions, and decreases in the other one of the regular, and reverse directions. It is preferable that the helix of the helical oil groove 143*b* is in a counter clockwise direction for increasing the oil supply rate in the regular rotation direction as the load is relatively greater in the regular direction rotation. It is important that helix angle and helix length of the helical groove 143*b* are set appropriately because the helix angle and the helix length may give influence to an oil supply performance itself. As shown in FIG. 4B, actually the helix angle and the helix length can be adjusted by an angle θ2 of relative offset between the lower end and the upper end of the oil groove 143 caused by the helical groove 143*b*, which is preferably in a range of 10°–30°.

The foregoing reduced oil groove 143 width 'b' and the partial helical groove 143*b* permit to maintain an appropriate gap between the frame 12 and the driving shaft 11, to form an adequate oil film, that leads to suppression of the wear in the wear region (the lower end of the oil groove and the vicinity thereof).

Figure 8A:
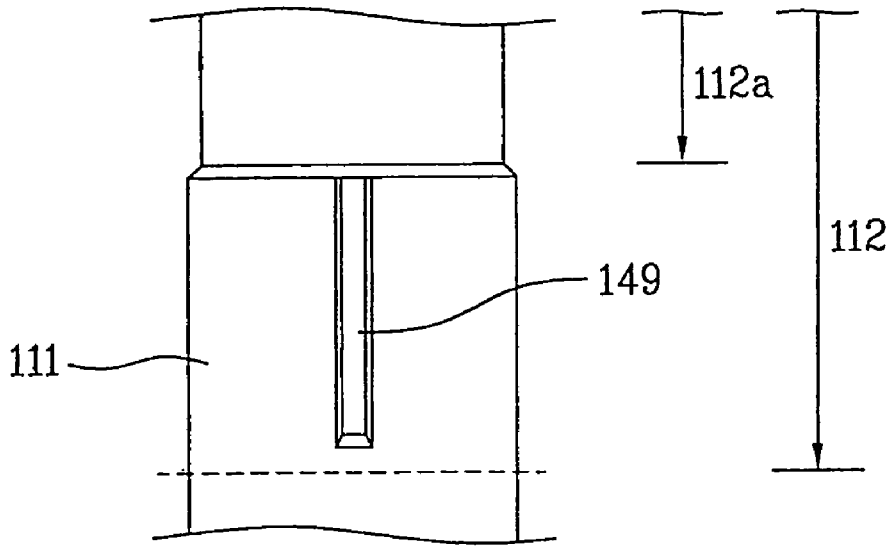
FIGS. 8A and 8B illustrate partial enlarged views of the crankshafts each showing a supplementary oil groove as one variation of FIG. 4.
Figure 8B:
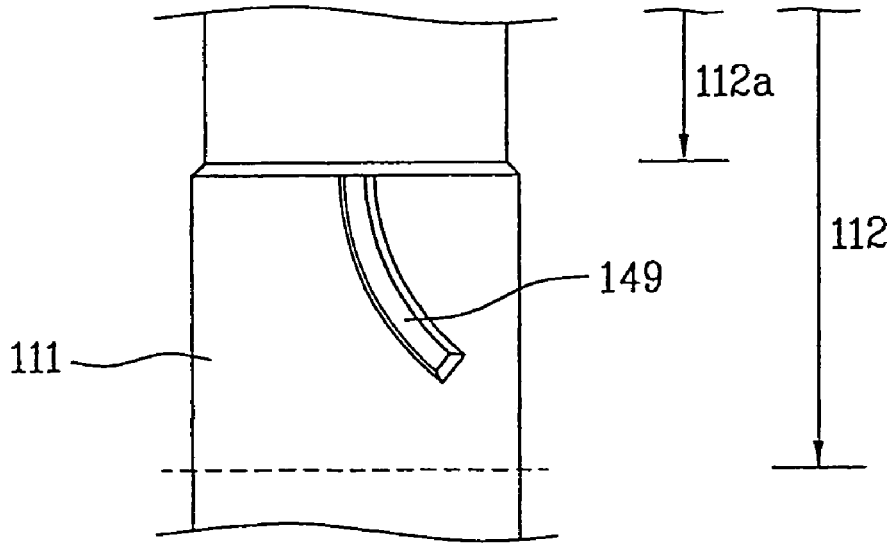

In the meantime, the straight oil groove 143 is shortened by the incremental height 'h' while the shaft oil hole 141 is extended for communication with the straight oil groove 143. However, the shortened oil groove 143 causes a problem of an inadequate oil supply to the lower part of the journal 112. As shown in FIGS. 4A, 4B, 8A, and 8B, for solving this problem, at least one supplementary oil groove 149 is further provided in a lower part of the journal. In more detail, the supplementary oil groove 149 is formed to be in communication with a small diametered part 112*a* of the journal 112 in a central part thereof for receiving the oil. The supplementary oil groove 149 is extended to the vicinity of the lower end of the journal 111 in an appropriate length so that an oil supply through the supplementary oil groove 149 supplements possible lack of a final oil supply rate at the pin oil hole 144. Therefore, the oil can reach to the lower part of the journal 112 from the small diametered part 112*a* through the supplementary oil groove 149. In this instance, similar to the case of the foregoing oil groove 143, the supplementary oil groove 149 may cause wear in the vicinity, and at a lower end thereof. Therefore, a width of the supplementary oil groove 149 is set to be below 2mm for reduction of wear in a circumference of the driving shaft 110. The lower end of the supplementary oil groove 149 is set to be at a location at least 3 mm higher than the lower end of the journal 112 for avoiding the oil film unstable region as far as possible. Because the supplementary oil groove 149 is an oil flow passage separate from the shortened oil groove 143, it is preferable that the oil groove 143 and the supplementary oil groove 149 are separated from each other for, not only prevention of a direct contact with the frame 12, but also an adequate oil supply to the lower part of the journal 112, with consequential formation of an even oil film. It is appropriate that an offset angle θ3 of the supplementary oil groove 149 from the oil groove 143 is greater than 90°. Moreover, the supplementary oil groove 149 may be straight as shown in FIG. 8A identical to the oil groove 143, or helical as shown in FIG. 8B for increasing an oil supply rate.

Figure 9:
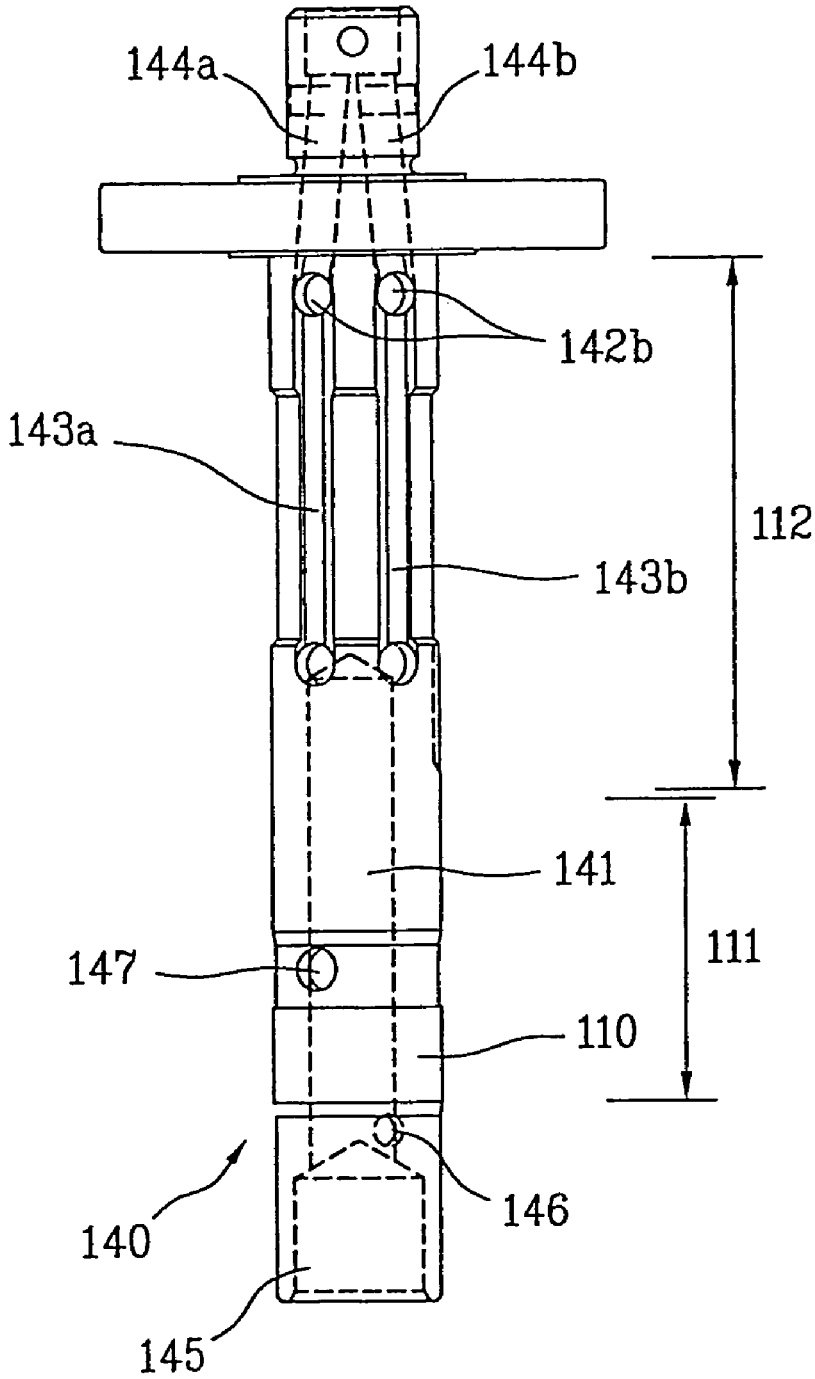
FIG. 9 illustrates a front view of a variation of the crankshaft with two straight oil grooves in accordance with a first preferred embodiment of the present invention.

Moreover, referring to FIG. 9, there may be one more straight oil groove formed in the crankshaft 100, to form total two straight oil grooves 143*a* and 143*b*, for increasing oil supply rates, not only to the radial bearing, but also an entire oil supply rate. This system of two straight oil grooves 143*a* and 143*b* also has all the characteristics of the single straight oil groove explained before.

Finally, referring to FIG. 3, the pin oil hole 144 is in communication with the oil groove 143, and extended to an upper part of the crank pin 120 through the balance weight 120 and an inside of the crank pin 130. That is, the pin oil hole 144 is opened to exterior in the upper part of the crank pin 130, and extended to a depth at which the pin oil hole 144 is connected to the oil groove 143. The pin oil hole 114 has a supply hole 148 extended to a circumferential surface of the crankpin 130.

In the meantime, there may be only one pin oil hole 144 even if there are more than one oil grooves 143*a* and 143*b* as shown in FIG. 9 by connecting to the pin oil hole 144 in common. However, because the oil grooves 143*a* and 143*b* are formed at locations offset from the crank pin center 'C.' under the reasons explained before respectively, formation of the single pin oil hole 144 is actually difficult, and costs high. Accordingly, formation of independent two oil holes 144*a* and 144*b* in communication with the two oil holes individually is preferable.

Opposite to this, if there are more than one oil grooves 143, though a plurality of shaft oil holes 141 may be formed for individual connection to the oil grooves 143, formation of a single common bole can reduce the fabrication process.

A process of oil flow in the foregoing crankshaft 100 in accordance with the first preferred embodiment of the present invention will be explained in detail with reference to related drawings.

Upon application of a power to the motor, the crankshaft 100 is rotated with the rotor 22 in the same direction, together with the oil pump 150 at the bottom of the crankshaft 100. In this instance, the oil is pumped to the shaft oil hole 141 as the oil moves upward riding on the propeller 152 of the oil pump 150, and, in succession, moves to the oil groove 143 through the lower connection hole 142*a*. Since there is at least one straight oil groove, the oil can flow in the oil groove 143 regardless of the rotation direction, i.e., the regular direction (clockwise direction), or reverse direction (counter clockwise direction). The oil forms an oil film between the frame 12 and the journal 112, at first. In a case there is the supplementary oil groove 149, the oil in a space between the small diametered part 112*a* and the frame 12 is supplied to the lower part of the radial bearing (the lower part of the journal) through the supplementary oil groove 149. Then, the oil moves up to the pin oil hole 144 through the upper connection hole 142*b*. As the oil flows in the pin oil hole 144, the oil is supplied to the crank pin 130 and driving components fitted thereto through the supply hole 148, and, finally, and sprayed from a top end of the pin oil hole 144 opened to exterior for supply to other driving parts of the compressor.

Thus, since the straight groove 143 can move the oil for both of the rotation directions, the oil passage 140 serves as a regular direction and a reverse direction oil passages, to supply oil to various driving parts of the compressor.

SECOND EMBODIMENT

Figure 10:
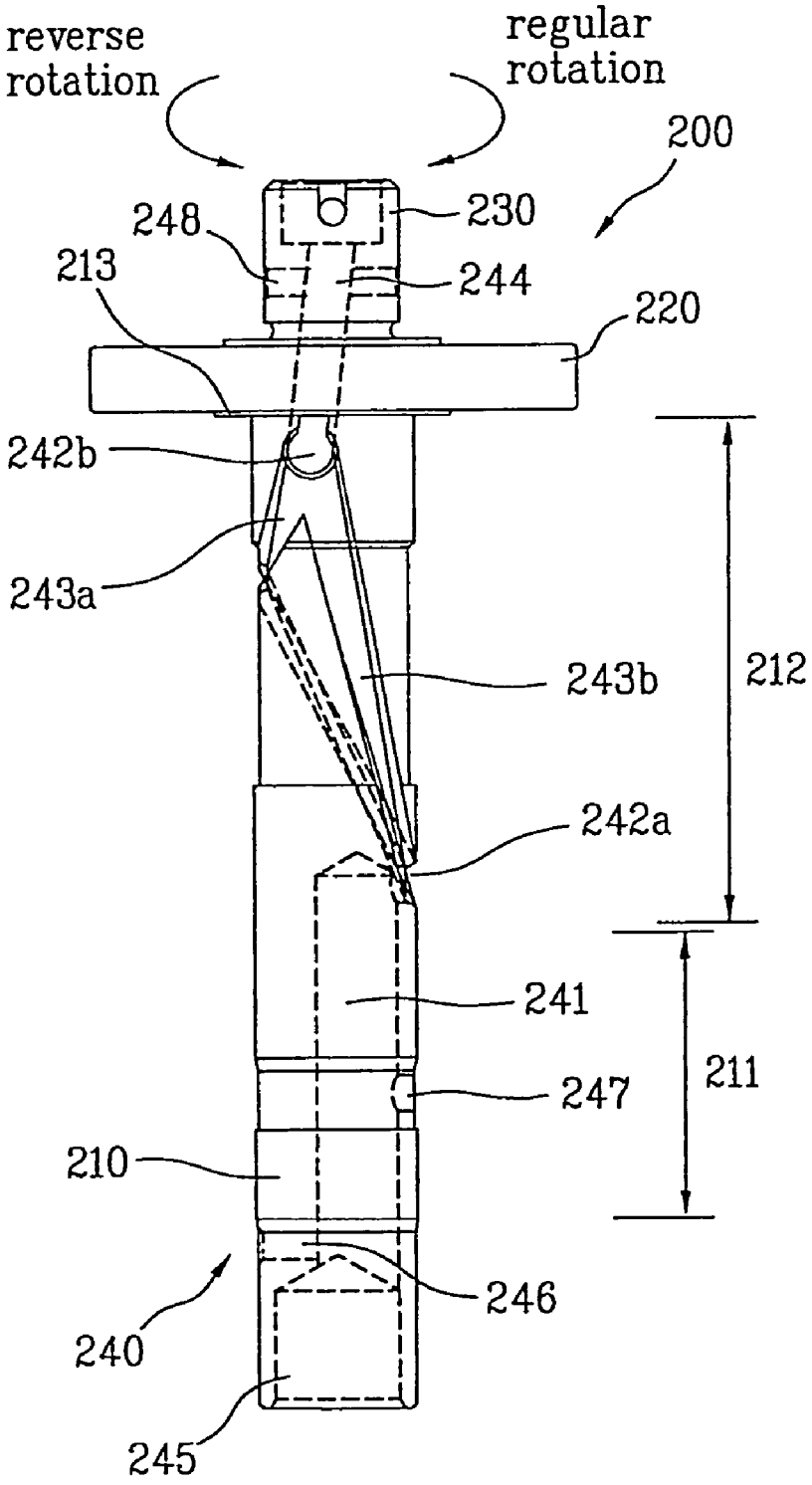
FIG. 10 illustrates a front view of a crankshaft of a dual capacity compressor in accordance with a second preferred embodiment of the present invention.
Figure 11:
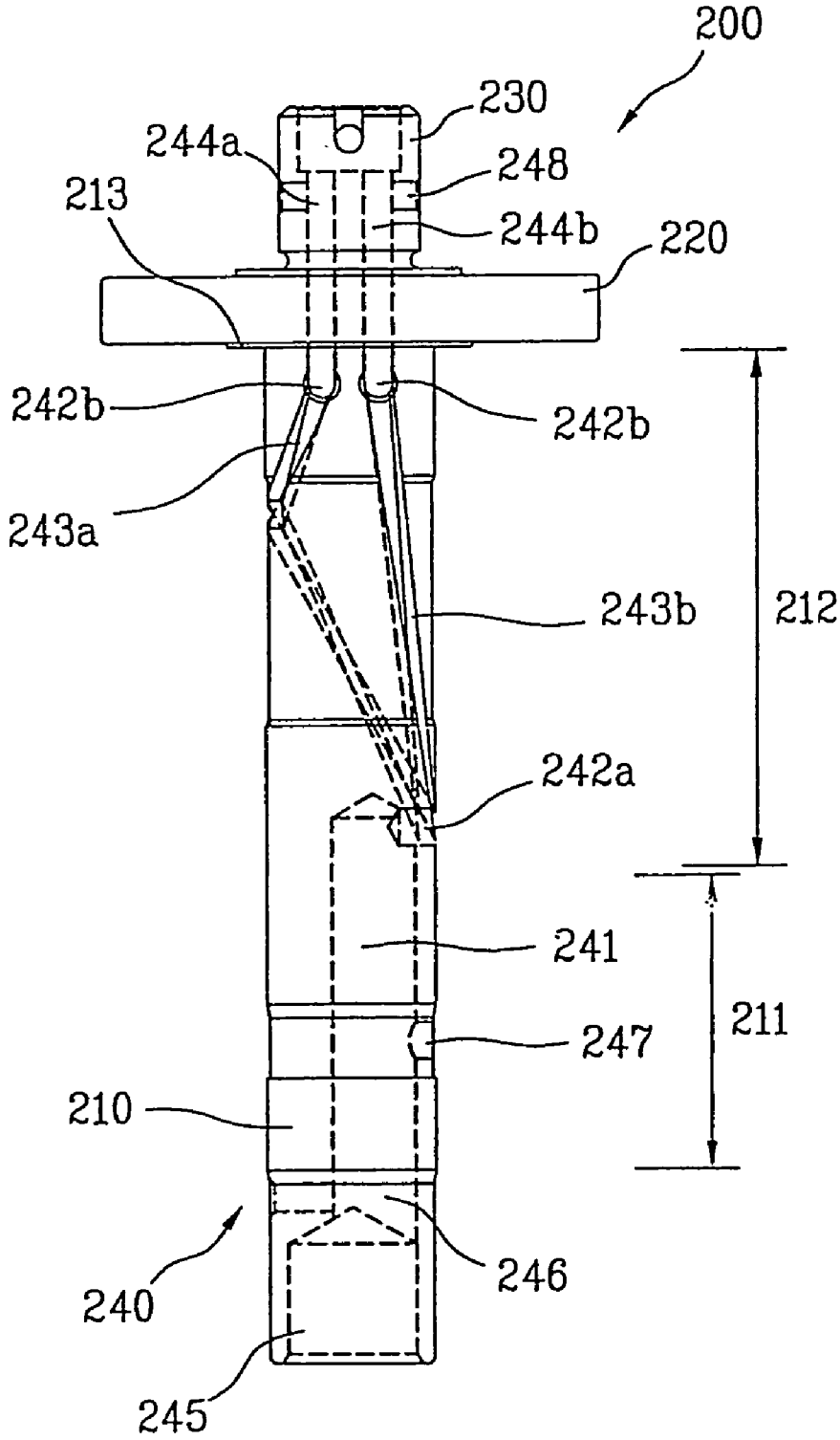
FIG. 11 illustrates a front view of a variation of the crankshaft with two separate helical oil grooves in accordance with a second preferred embodiment of the present invention.
Figure 12:
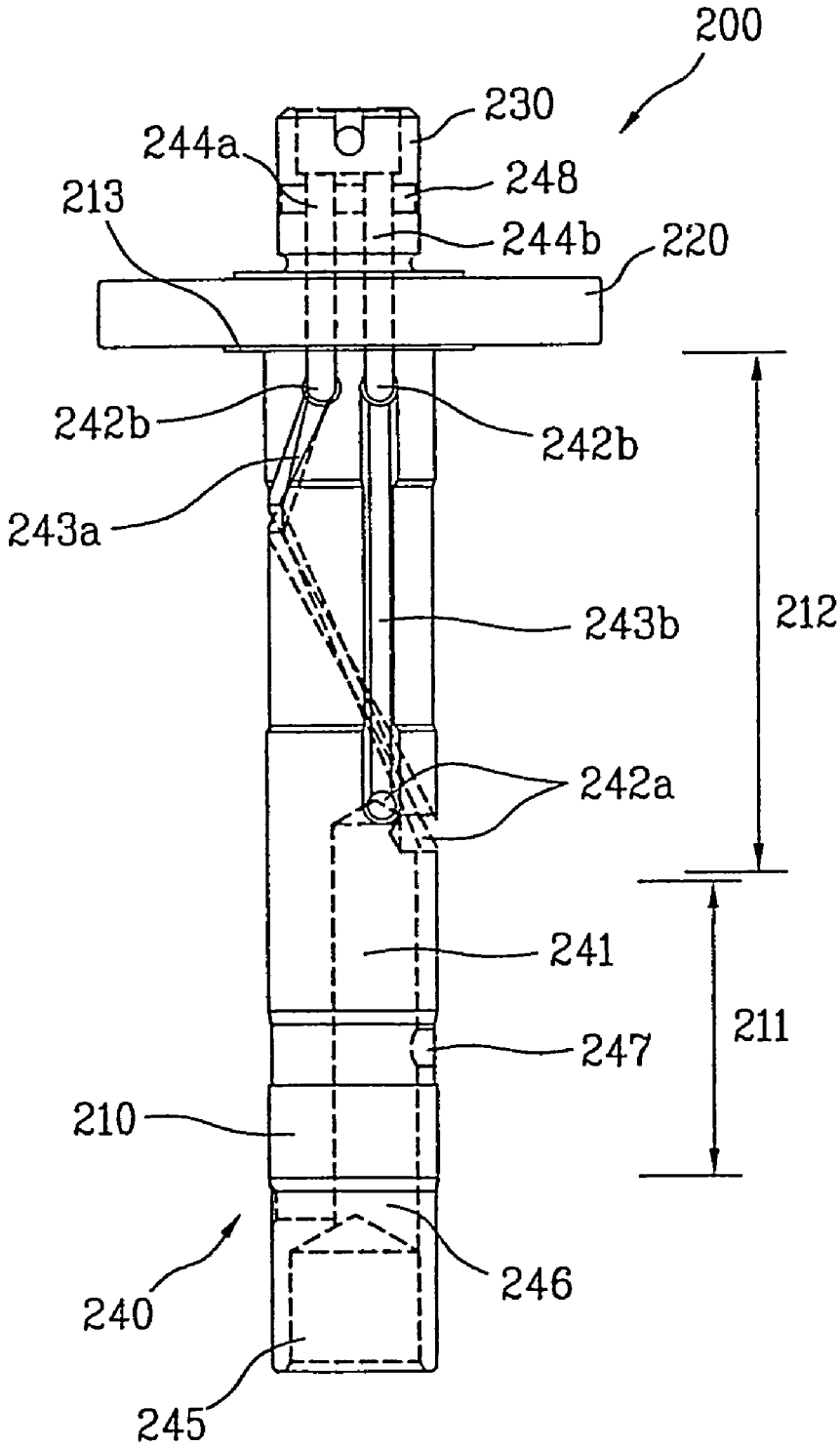
FIG. 12 illustrates a front view of a variation of the crankshaft with straight, and helical oil grooves in accordance with a second preferred embodiment of the present invention.

FIG. 10 illustrates a front view of a crankshaft of a dual capacity compressor in accordance with a second preferred embodiment of the present invention, and FIGS. 11 and 12 illustrate variations of the crankshaft in accordance with a second preferred embodiment of the present invention, referring to which the second preferred embodiment of the present invention will be explained.

Referring to FIG. 10, the crankshaft 200 includes a driving shaft 210, a balance weight 220, a crank pin 230, and a regular and reverse direction rotation oil passage 240 along the crank shaft 200. The driving shaft 210 includes a collar 213, a journal 212 and a rotor fitting part 211 in a lower part and an upper part of the driving shaft 210, respectively. The balance weight 220 is at a top end of the driving shaft 210, and the crank pin 230 is on a top surface of the balance weight 220.

Detailed explanations of parts in the second embodiment identical to the first embodiment will be omitted, and the regular/reverse rotation oil passages 240 of the second embodiment will be explained focused on differences from the first embodiment in detail.

The regular and reverse direction rotation oil passage 240 includes a shaft oil hole 241 in a lower part 210 of the driving shaft, at least one helical oil groove 243 in the driving shaft 210 in communication with the shaft oil hole 241, and a pin oil hole 244 in the crank pin 230 in communication with the oil groove 243. Detailed explanations of parts in the foregoing regular and reverse direction rotation oil passage 240 of the second embodiment identical to the first embodiment will be omitted.

The shaft oil hole 241 has a pump seat 245 at a bottom end thereof for seating an oil pump (not shown). Also, the shaft oil hole 241 has a gas hole 246 and a sediment hole 247 for discharging gas and sediment to outside of the crankshaft 200.

The oil groove 243 has upper and lower connection holes 242*a* and 242*b* for connecting the oil groove 243 itself to the shaft oil hole 243 and the pin oil hole 244, and, as shown in FIG. 10, two helical grooves 243*a* and 243*b*. In more detail, as explained before, since a helical groove can make the oil to flow only in one of the rotation directions of the crankshaft 200, two separate helical oil grooves in correspondence to respective rotation directions are provided, which are extended in opposite directions (the regular direction and the reverse direction).

In this instance, greater compression capacity, and load are required for one of the rotation directions in the dual capacity compressor, a greater oil supply rate is required for, particularly, the radial bearing part. Accordingly, for securing adequate oil supply rate, it is preferable that a helical groove 243*a* having an oil flow in a rotation that requires higher load (the regular rotation in the drawing) has a longer helical groove than the other helical groove 243*b*.

When the oil grooves 243*a* and the 243*b* cross on the outer circumference of the driving shaft, the oil flows to the other oil groove 243*a* in course the oil moves upward in one 243*a* of the oil grooves, that causes a reduction of the oil supply rate to the pin oil hole 244 failing to lubricate entire driving parts, adequately. Therefore, it is important that the oil grooves 243*a* and the 243*b* are not crossed in view of oil supply performance.

Alikely, as shown in FIG. 10, there are also the oil leakage to the other oil groove and the reduction of the oil supply rate to the pin oil hole if top ends of the oil grooves 243*a* and 243*b* are met. Therefore, as shown in FIG. 11, for prevention of the oil supply rate from becoming poor, top ends of the oil grooves 243*a* and 243*b* are required to be separated from each other, such that oil holes 243*a* and 243*b* are connected to the connection holes 242*b* and 242*c* and pin holes 243*a* and 243*b*, respectively. Since lower ends of the oil grooves 243*a* and 243*b* have no possibility of oil leakage, it is preferable that the oil grooves 243*a* and 243*b* are made to meet with each other to share on connection hole 242*a*, for simplicity of the structure.

In this instance, it is preferable that the helical oil groove 243*a* is in charge of oil flow in a rotation (the regular rotation in the drawing) that generates a heavier load for coping with a relatively heavy load. Because the helical groove 243*a* has an oil supply rate greater than the straight oil groove 243*b* owing to its longer oil groove.

Similar to the variation in FIG. 11, in order to prevent the oil from leaking to an opposite oil groove, the oil grooves 243*a* and 243*b* in the variation in FIG. 12 are required not to cross each other, or the top ends of the oil grooves 243*a* and 243*b* are required not to meet each other.

Finally, the pin oil hole 244 includes a supply hole 248 extended inward from a circumference of the crank pin 230 and connected to the pin oil hole 244 itself. The pin oil hole 244 may be a single hole to which the oil hole 243*a* and 243*b* are connected in common. Since the oil is stagnant slightly in the pin oil hole during the oil is supplied from one of the oil grooves, there is a possibility that the oil leaks back to the other oil groove connected to the pin oil hole if the pin oil hole is single. For preventing such an oil supply loss, it is preferable that there are two independent pin oil holes 244*a* and 244*b* connected to the oil grooves 243*a* and 243*b*, respectively. Opposite to this, it is preferable that there is single shaft oil hole 241 for reduction of fabrication steps.

The process of oil flow in the foregoing crankshaft 200 in accordance with the second preferred embodiment of the present invention will be explained with reference to related drawings.

Upon application of power to the motor, the oil pump, rotating with the crankshaft 200, draws the oil in the bottom of the compressor into the shaft oil hole 241, and, in succession, the shaft oil hole 241 transfers the oil to the oil groove 243 through the lower connection hole 242*b* by a centrifugal force. There are two oil paths in the second embodiment; a regular rotation direction oil path which starts from the shaft oil hole 241, and ends at the pin oil bole 241 through the first helical oil groove 243*a*, and a reverse rotation direction oil path which starts from the shaft oil hole 241, and ends at the pin oil hole 241 through the second helical oil groove 243*b*, such that the oil flows only through the first helical groove 243*a* in th regular direction rotation, and only through the second helical groove 243*b* in the reverse direction rotation. After one of the helical oil grooves 243*a* and 243*b* pertinent to the rotation direction supplies the oil to the thrust and radial bearings, the pin oil hole 244 supplies the oil to various driving parts through the upper connection hole 242*a*.

On the whole, the oil paths in the second embodiment are provided separately for regular and reverse direction rotations by using the two helical grooves 243*a* and 243*b*, that permits an appropriate lubrication of various parts.

THIRD EMBODIMENT

Figure 13:
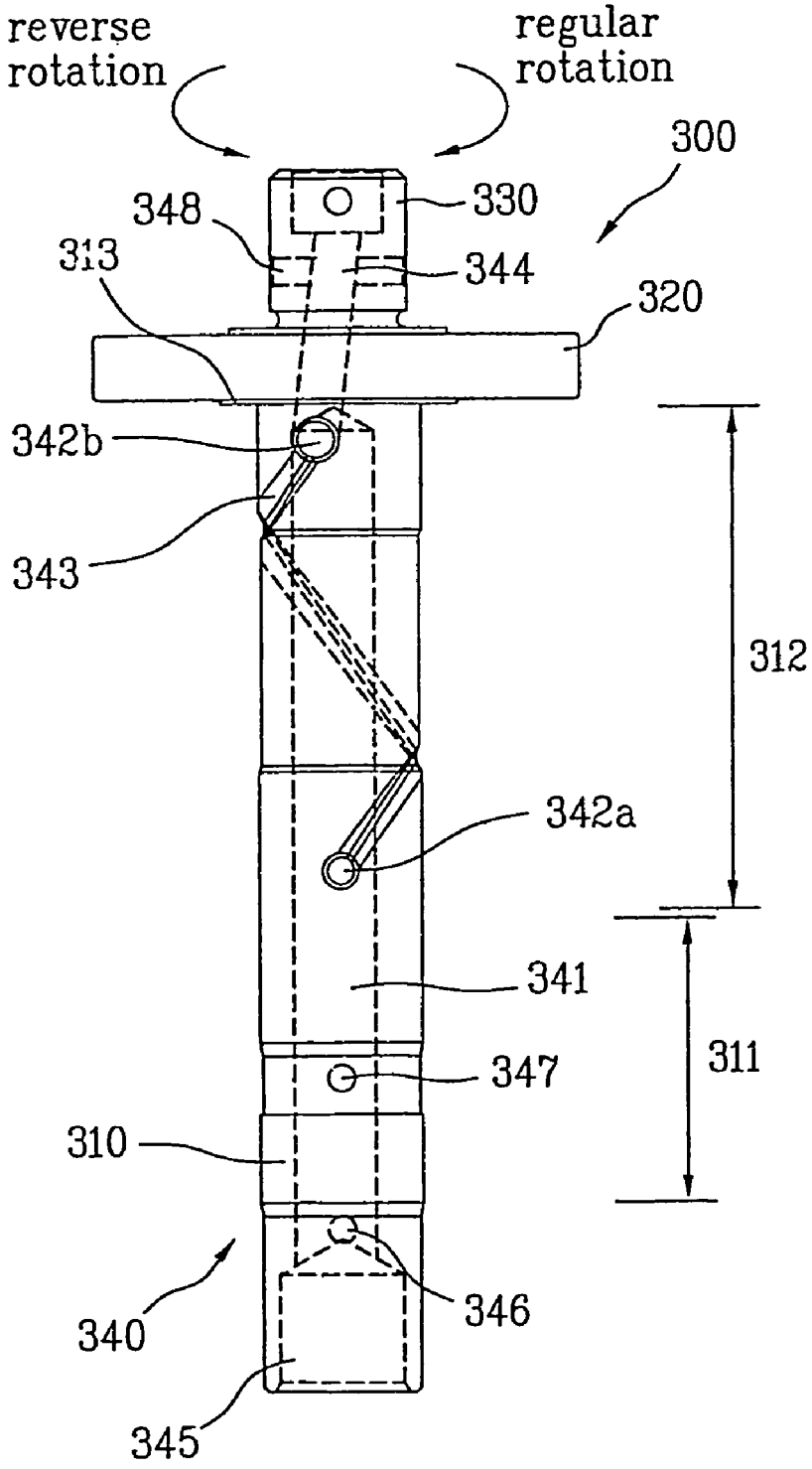
FIG. 13 illustrates a front view of a crankshaft of a dual capacity compressor in accordance with a third preferred embodiment of the present invention.

FIG. 13 illustrates a front view of a crankshaft of a dual capacity compressor in accordance with a third preferred embodiment of the present invention, and FIGS. 14 to 17 illustrate variations of the crankshaft in accordance with the third preferred embodiment of the present invention, referring to which the third preferred embodiment of the present invention will be explained.

Referring to FIG. 13, the crankshaft 300 includes a driving shaft 310 having a fitting part 311, a journal 312, and a collar 313, a balance weight 320, a crank pin 330, and a regular and reverse direction rotation oil passage 340 along the crank shaft 300. Detailed explanations of parts in the third embodiment identical to the first or second embodiment will be omitted, and only the regular/reverse rotation oil passages 340 of the third embodiment will be explained in detail.

The regular and reverse direction rotation oil passage 340 includes at least one shaft oil hole 341 in the driving shaft 310, a pin oil hole 344 in the crank pin 230 in communication with the shaft oil hole 341, and at least one oil groove 343 in the driving shaft 310 in communication with the shaft oil hole 341.

Figure 14A:
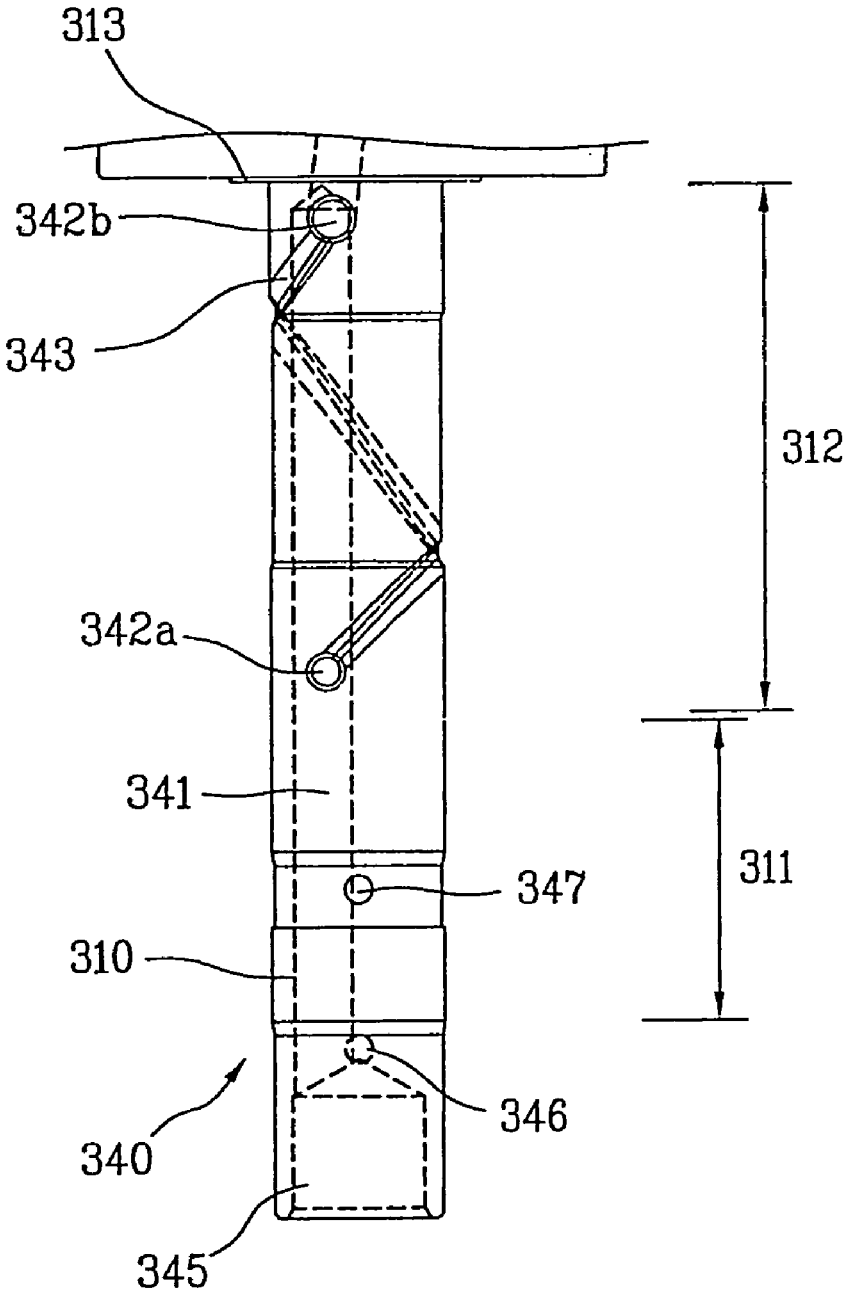
FIGS. 14A–14C illustrate front views of variations of shaft oil holes in accordance with a third preferred embodiment of the present invention, respectively.
Figure 14B:
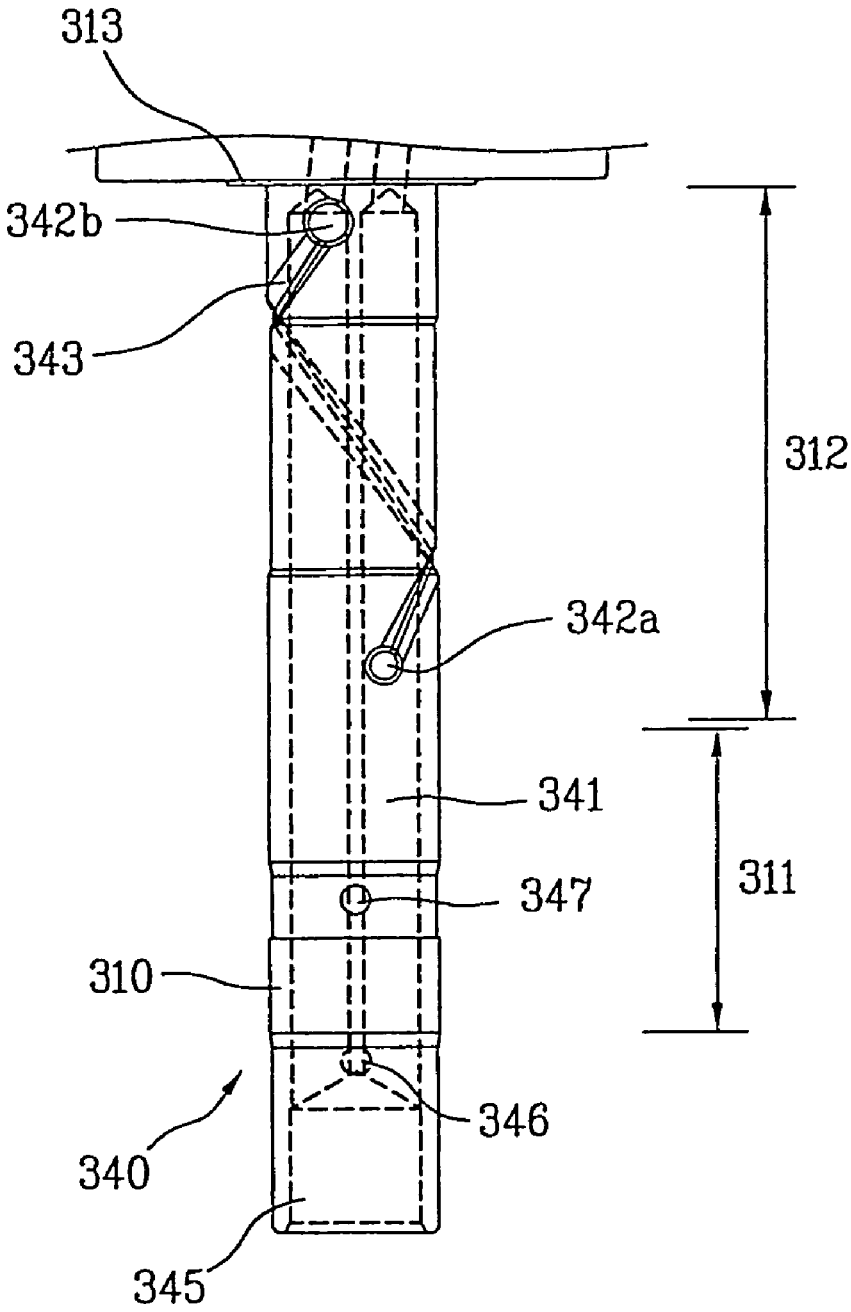
Figure 14C:
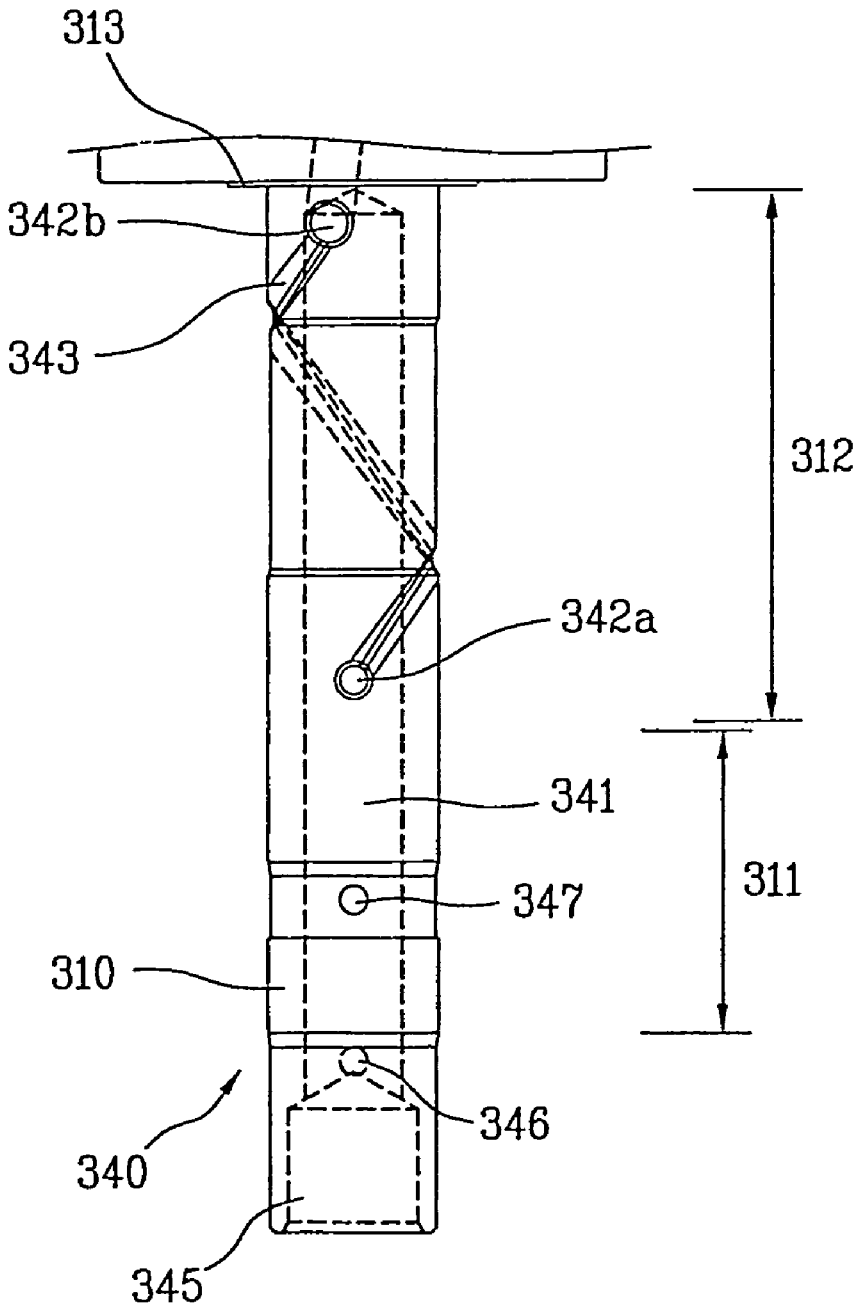

The shaft oil hole 341 has a pump seat 345, a gas hole 346, and a sediment hole 347, and is extended longitudinally to a location in the vicinity of the crank pin 330 through an inside of the driving shaft until connected to the pin oil hole 344. That is, the driving shaft 310 is almost hollow due to the shaft oil hole 341. There may be one shaft oil hole 341 eccentric to the axis of the driving shaft as shown in FIG. 14A, or two shaft oil holes 341 eccentric to the axis of the driving shaft parallel to each other as shown in FIG. 14B, or one shaft oil hole 341 coaxial with the driving shaft as shown in FIG. 14C. Of the different forms of shaft oil holes 341, the coaxial hole can provide a large oil supply rate as the coaxial hole can be the greater than the eccentric holes. However, the single eccentric hole is preferable in comparison to the coaxial hole in that no accurate machining (coaxial machining) is required, with less drop of strength of the crankshaft itself.

The oil groove 343 is in communication with the shaft oil hole 341 at one or more than one locations, and is extended in an outer circumferential surface of the driving shaft 310. In more detail, as the shaft oil hole 341 is connected to the pin oil hole 344 directly, the oil groove only serves for oil supply to the bearings using the oil branched from the holes 341 and 344.

Figure 15:
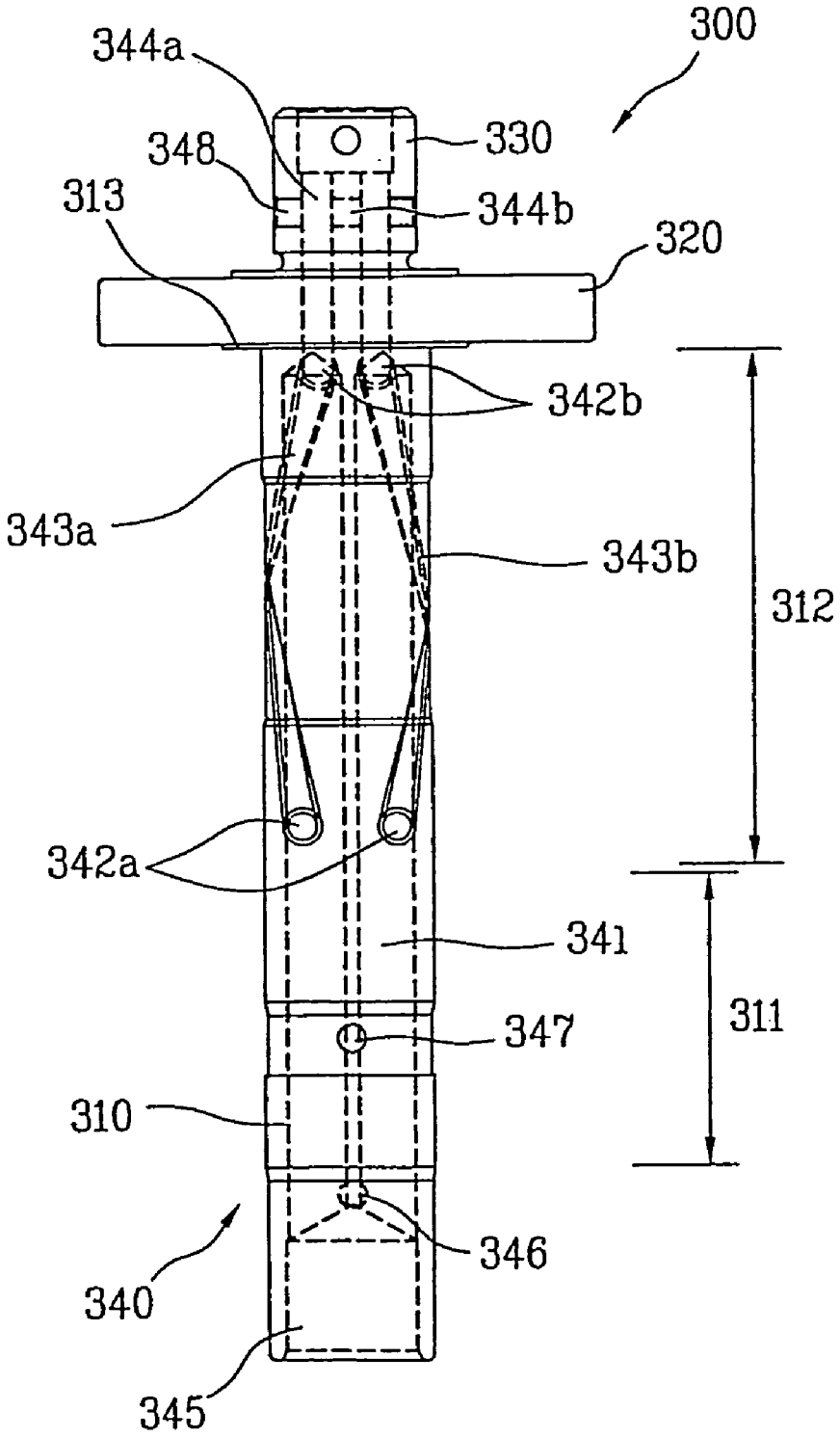
FIG. 15 illustrates a front view of a variation of the crankshaft with separate helical oil grooves in accordance with a third preferred embodiment of the present invention.

Referring to FIG. 13, the oil groove 343 may be singular. In this singular helical oil groove, upper and lower ends thereof are connected to the shaft oil hole 341 through upper and lower connection holes 342*a* and 342*b*. Therefore, the oil moves upward along the helical groove 343 in one direction rotation (a regular direction rotation in the drawing), and, opposite this, the oil flows back from an upper end to a lower end of the single helical groove 343 in the other direction rotation, for making the oil supply to the bearings. In the meantime, as already shown in FIG. 13, since oil supply rate is greater in the upward flow than the backward flow, the helical groove.343 is preferably formed to supply oil in a regular direction rotation when a relatively greater load is occurred for adequate supply of oil. Moreover, it is favorable that the upper end and the lower end of the single helical groove 343 are not on the same straight line in view of prevention of wear. Furthermore the oil groove 343 may be two helical grooves extended in opposite directions. That is, the oil groove 343 may be two helical grooves 343*a* and 343*b* fully independent (separate) from each other as shown in FIG. 15, or two helical grooves 343*a* and 343*b* having upper and lower ends connected to each other respectively as shown in FIG. 16, or two helical grooves having any one of upper and lower ends connected to each other.

Of the foregoing different types of connections of the helical grooves, when both the upper end and the lower end are connected to the shaft oil hole 341 or to the pin oil hole 344, one of the helical groove moves upward from the lower end, while the other one of the helical groove moves down from the upper end for one direction rotation. However, the single helical groove can also supply adequate oil to the radial bearing, and the oil flow from the upper end reduces a final oil supply rate at the pin oil hole 344. Therefore, the helical grooves with connected both ends are not favorable for uniform oil supply, on the whole.

The oil groove 343 in the third embodiment does not connect the shaft oil hole 341 and the pin oil hole 344 for forming a continuous oil passage like the previous embodiments. Therefore, there are two helical grooves, it is not required that all the upper ends and the lower ends are connected to the shaft oil hole 341 or the pin oil hole 344, but selectively. In this instance, since the oil flow from the lower end by using the centrifugal force is greater, connection only at the lower end is favorable in the bearing lubrication.

Figure 16:
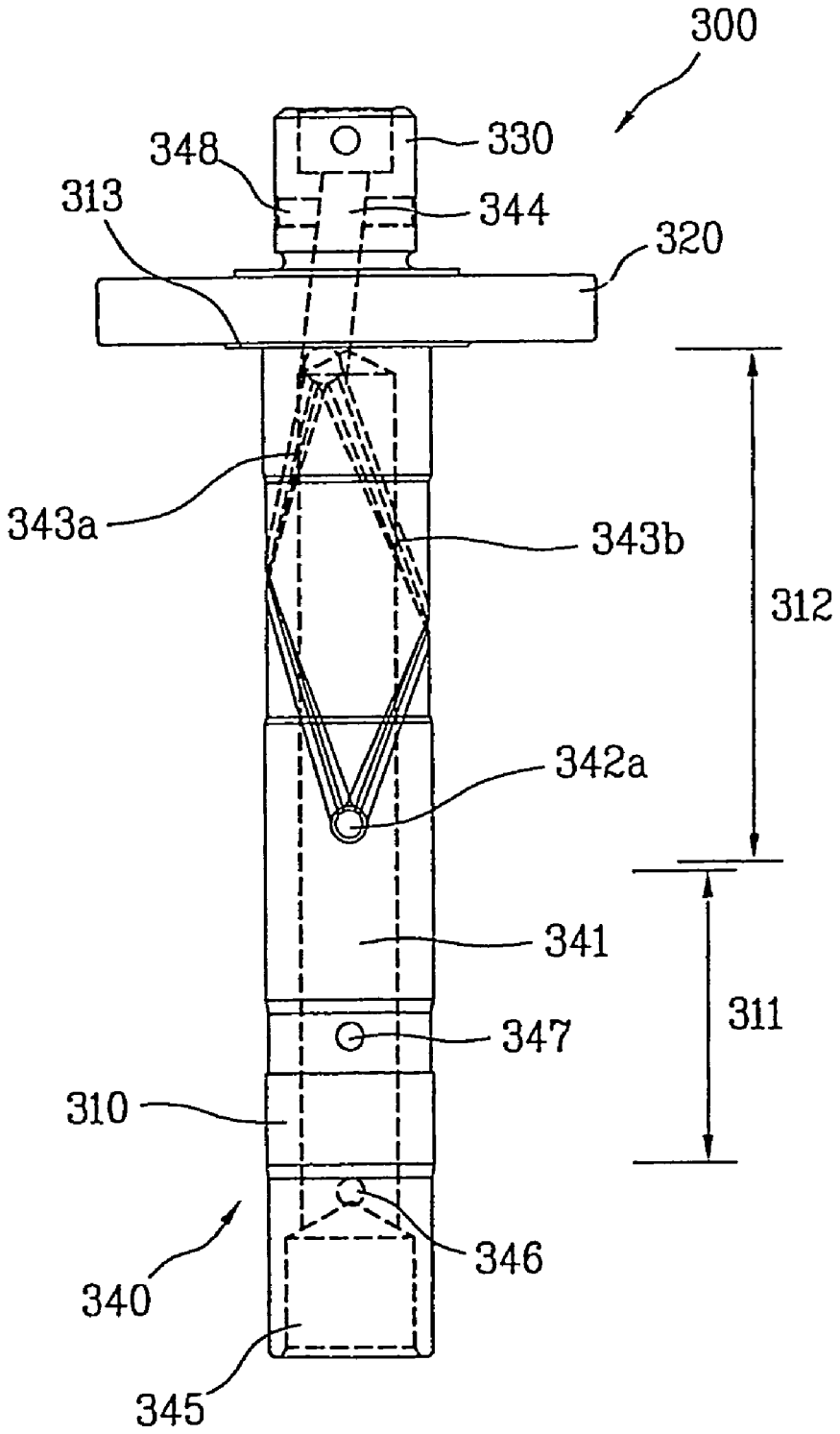
FIG. 16 illustrates a front view of a variation of the crankshaft with helical oil grooves connected to each other in accordance with a third preferred embodiment of the present invention.

In this instance, if the upper ends of the two helical oil grooves 343*a* and 343*b* are connected, the two helical oil grooves 343*a* and 343*b* actually form a circulative passage as shown in FIG. 16, making more uniform oil supply to the bearing. It is preferable that the lower ends of the oil grooves 343*a* and 343*b* connected to the shaft oil hole 341 through one common connection hole 342*a* for simplicity of a structure. At the end, as shown in FIG. 16 exactly, in the two helical oil groove 343*a* and 343*b* application, the structure is the most effective, in which both ends are connected to each other, the lower ends are in connected, and the upper ends are closed.

In the meantime, the helical oil grooves 343*a* and the 343*b* have characteristics similar to the helical grooves 243 in the second embodiment. That is, it is preferable that the helical oil grooves 343*a* and the 343*b* does not cross each other for prevention of the oil from changing the path.

Figure 17:
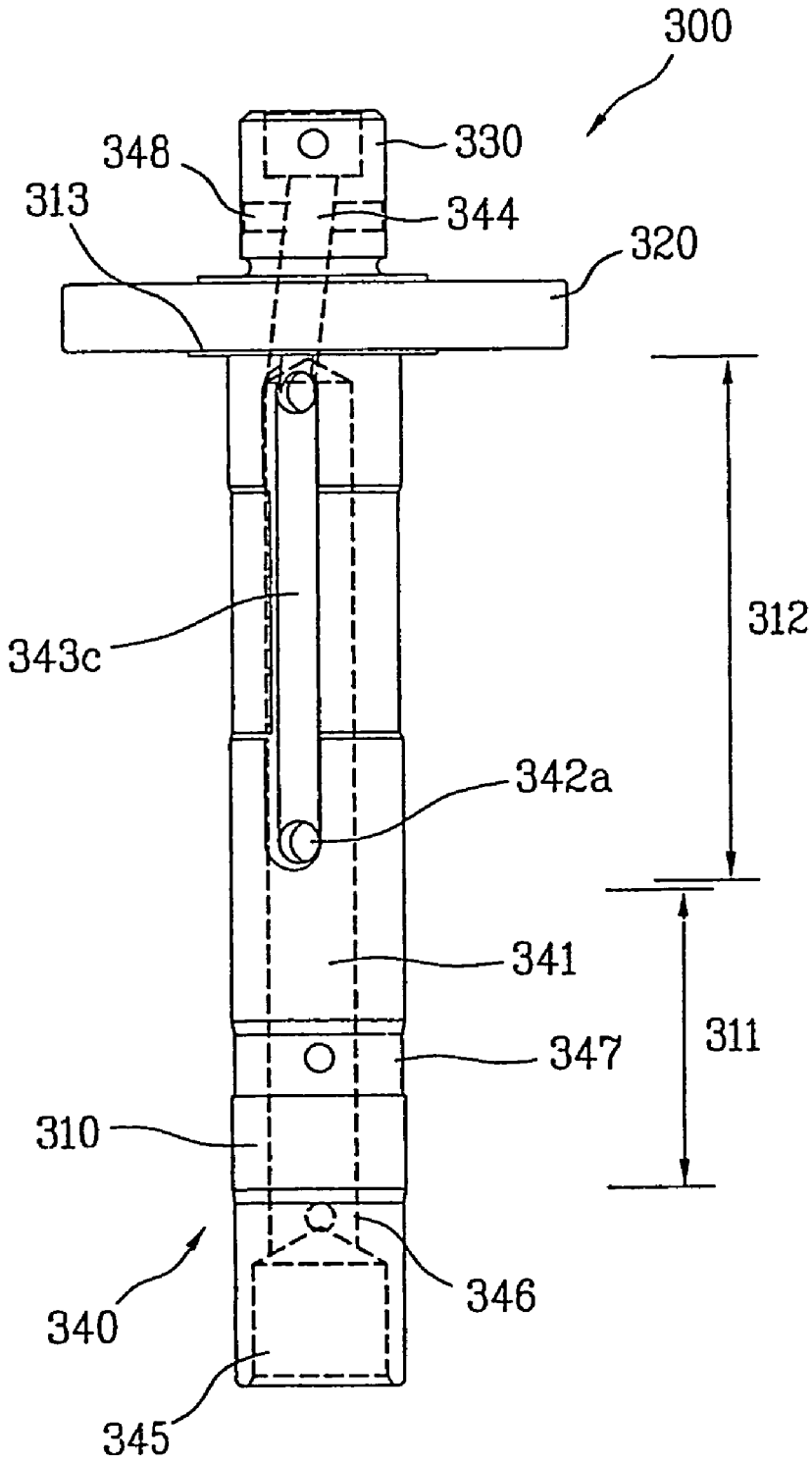
FIG. 17 illustrates a front view of a variation of the crankshaft with a straight oil groove in accordance with a third preferred embodiment of the present invention; and, FIGS. 18A–18C illustrate front views of crankshafts in inverted type compressors in accordance with other preferred embodiments of the present invention.

Referring to FIG. 17, the oil groove 343 may be a straight groove 343*c*, which permits oil flow regardless of the rotation direction as explained in the first embodiment, allowing oil supply to the radial bearing by means of only one straight groove. For increased oil supply, two straight oil grooves may be provided. In this straight grooves, both the upper part and the lower part can be connected, it is preferable that only the lower ends are connected to the connection hole 342*a* for simplicity of the structure.

Finally, the pin oil hole 344 is connected to the shaft oil hole 341 directly, and extends from an upper end of the shaft oil hole 341 to a top end of the crank pin 330 through insides of the balance weight 320 and the crank pin 330. That is, the pin oil hole 344 forms an independent oil passage from the oil groove 343, together with the shaft oil hole 341, which can supply oil to parts around the crank pin 330, regardless of the rotation direction. The pin oil hole 344 may be singular hole connected to one or more shaft oil holes 341 in common. Or, as shown in FIG. 15, there may be pin oil holes 344*a* and 344*b* connected to a plurality of the shaft oil holes 341, respectively.

The process of oil flow in accordance with the third preferred embodiment of the present invention will be explained with reference to related drawings.

When the crankshaft 300 starts to rotate in one direction as a power is applied to the compressor, the oil pump draws the oil in the bottom of the compressor into the shaft oil hole 341. Then, a portion of the oil moves up continuously by the centrifugal force, and the other portion is discharged to the oil groove 343.

If the oil groove 343 is singular helical as shown in FIG. 13, the oil moves up along the helical groove 343 from the connection hole 342*a*, and joins with the oil in the shaft oil hole 341 moving up through the connection hole 342*b* at the end. Opposite to this, in the reverse direction rotation, the helical groove 343 can not cause the oil to flow from the lower end owing to a direction of extension of the helical groove 343. Instead, a portion of the oil in the shaft oil hole flows out of the upper end of the shaft oil hole through the connection hole 342*b*, and moves back along the oil groove 343, and re-joins with the oil in the shaft oil hole 341 through the lower connection hole 342*a*.

If the two independent helical grooves 343*a* and 343*b* are used as shown in FIG. 15, in the regular direction rotation, the oil moves up from the lower end along the helical groove 343*a*, and, opposite to this, the oil moves down from the upper end along the other helical groove 343*b*. In the reverse direction rotation, the oil flow is made opposite to above. If the upper end is closed for preventing excessive oil flow in the oil groove 343, the oil grooves 343*a* and 343*b* permit oil flows in pertinent directions.

In the case of two helical grooves 343*a* and 343*b* having both ends connected, if both the upper ends and the lower ends are connected to the shaft oil hole 341, the oil flows identical to the embodiment explained in association with FIG. 15. On the other hand, if only the upper ends are closed as shown in FIG. 16, the oil circulates the two connected helical grooves 343*a* and 343*b*. In more detail, in both of the regular direction rotation and the reverse direction rotation, the oil moves up to the upper end along one of the helical grooves through the connection hole 342*b*, thereafter moves down from the upper end along an opposite helical groove, and finally joins with the rising oil in the shaft oil hole 341 through the connection hole 342*b*. This circulation facilitates a uniform supply of oil to the radial bearing without reduction of oil to the pin oil hole 344.

Referring to FIG. 17, if the oil groove 343 is a straight oil groove 343*c*, the oil can flow regardless of the rotation direction, of which explanation of operation will be omitted since the operation is identical to the first embodiment.

In the meantime, independent from the oil flow in the oil groove 343, the oil moves up along the shaft oil hole 341 up to a top end of the driving shaft 310, and, therefrom to a driving part connected to the crank pin 330 through the pin oil hole 344 and the supply hole 348 connected in succession, and sprayed from the oil hole 344 onto other driving parts, directly.

In summary of the third embodiment, the shaft oil hole 341 and the pin oil hole 344 are connected directly, to permit an oil flow passage independent from the oil groove 343, which allows an oil flow both in regular/reverse rotation directions. Along with this, the oil groove 343 is a supplementary structure that makes to cause an oil flow around the journal 311 in all rotation directions in association with the shaft oil groove 341 and the pin oil hole 344. Accordingly, alike the first or the second embodiment, the third embodiment crankshaft can supply oil to required parts of the compressor regardless of the rotation direction by individual oil flow at the shaft/pin oil holes 341 and 344, and the oil groove.

OTHER EMBODIMENTS

Figure 18A:
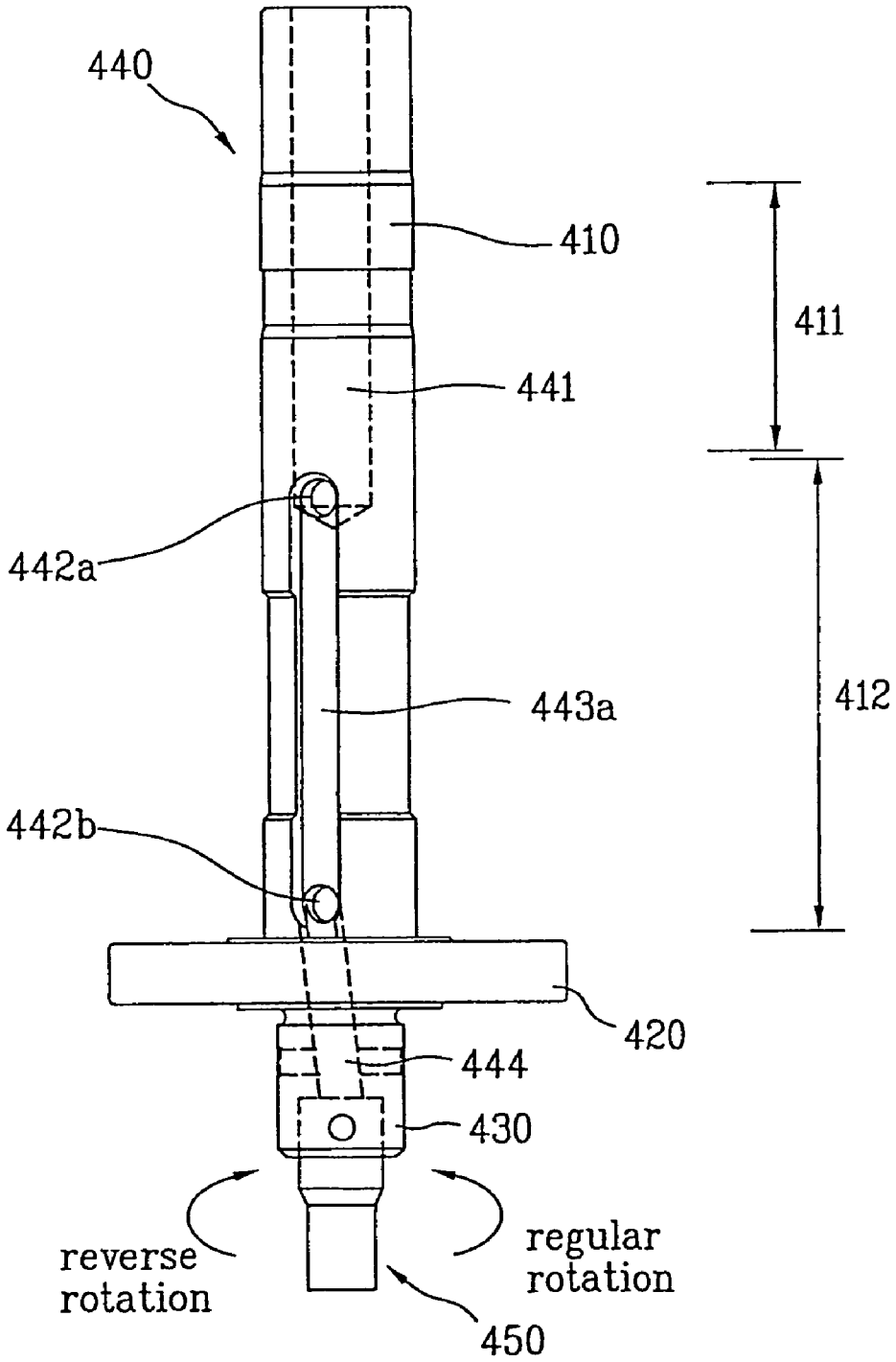
Figure 18B:
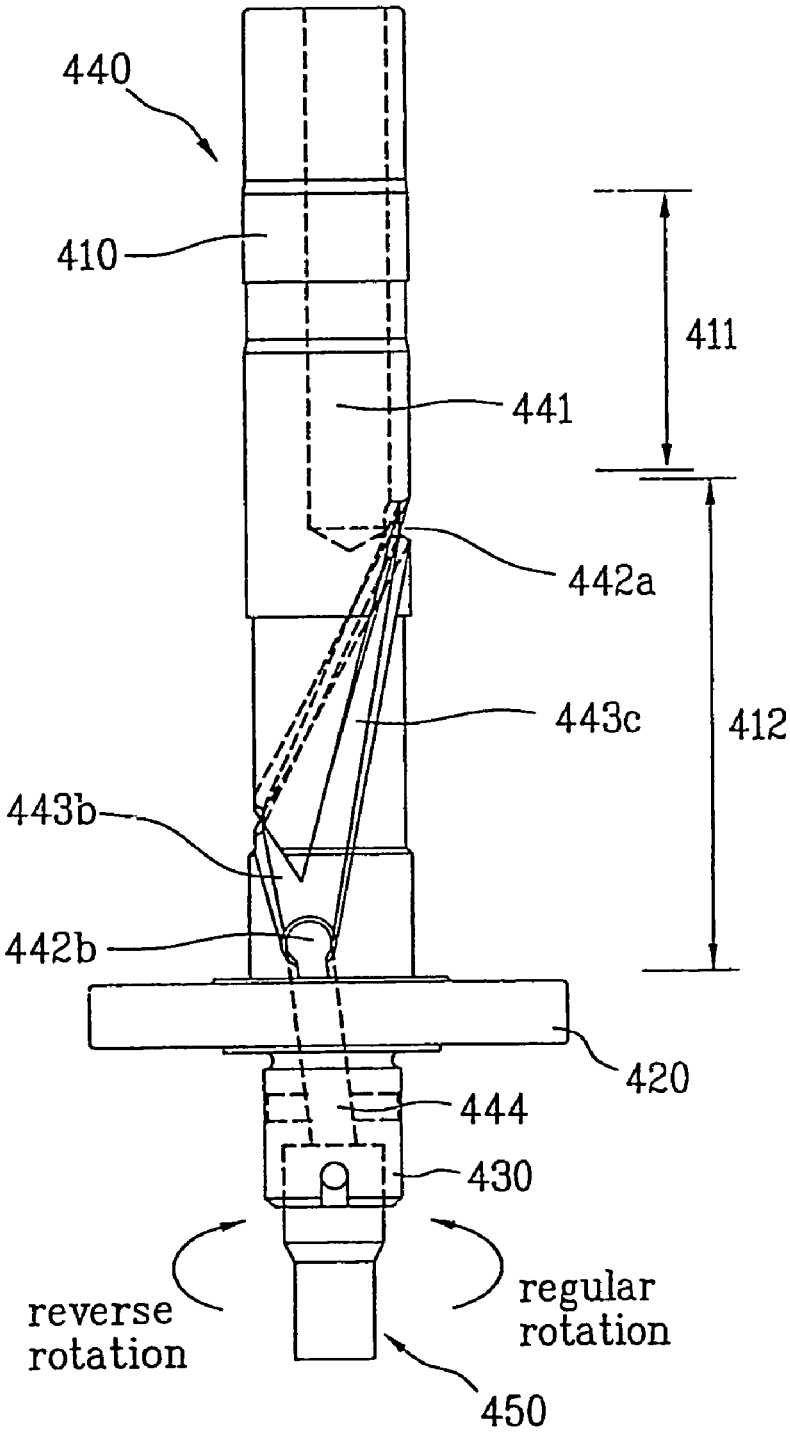
Figure 18C:
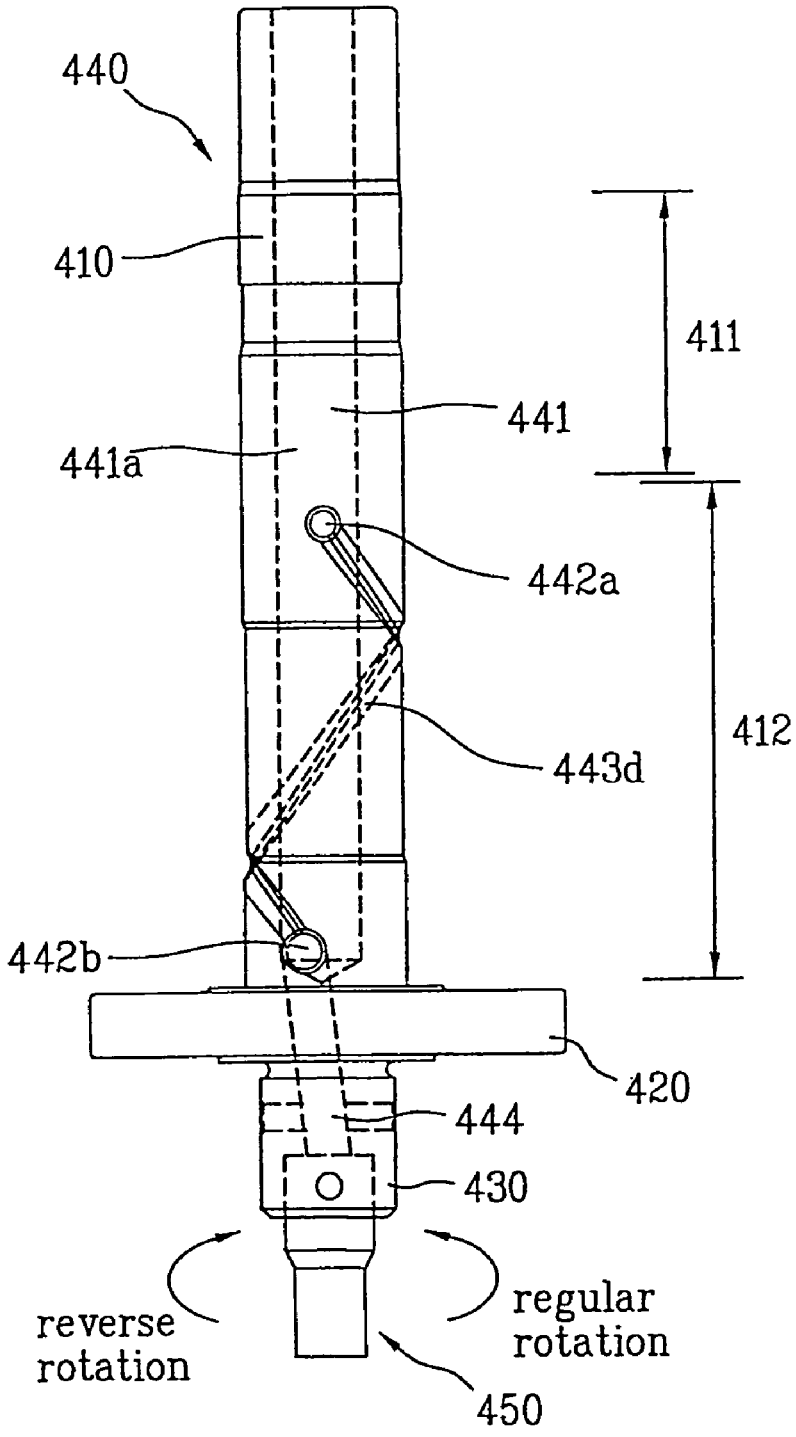

In reciprocating type compressors, different from a type shown in FIG. 1, there are compressors in each of which internal components 20, 30, and 40 are inverted according to installation and/or service conditions. That is, the power generating part 20 is located in a lower part of the compressor, and the compression part 30 and the stroke varying part 40 are located in the upper part of the compressor, with related members, such as frame 12, adaptively modified. FIGS. 18A–18C illustrate front views of crankshafts in inverted type compressors in accordance with other preferred embodiments of the present invention, referring to which the embodiments will be explained.

As shown, in general, the crankshaft 400 in the inverted type dual capacity compressor includes a driving shaft 410 fixed to the power generation part, a balance weight 420, a crank pin 430 connected to the compression part, and a regular/reverse direction rotation oil passage 440 formed throughout the crankshaft 400. In this instance, according to the inverted internal structure, the balance weight 420 is on a top end of the crank pin 430, and the driving shaft 410 is on a top surface of the balance weight 420. The oil pump 50 is fitted inside of the crank pin 430. Similar to this, in the driving shaft 410, the rotor fitting part 411 is inverted so as to be located on the journal 412.

In detail, the regular/reverse direction rotation oil passage 440 includes a shaft oil hole 441 in an upper part of the driving shaft 410, a pin oil hole 444 in the crank pin, and an oil groove 443 connected to the shaft oil hole 441 and the pin oil hole 444 by upper, and lower connection holes 442*a* and 442*b*, respectively. The oil groove 443 in the embodiment shown in FIG. 18A is a straight oil groove 443*a* like the first embodiment (FIG. 2), the oil groove 443 in the embodiment shown in FIG. 18B includes two helical oil grooves 443*b* and 443*c* in correspondence to respective rotation directions of the compressor like the second embodiment (FIG. 13), and the oil passage 440 in the embodiment shown in FIG. 18C includes a shaft oil hole 441*a* directly connected to the pin oil hole 444, and an oil hole 441*d* connected to the shaft oil hole 441*a* like the third embodiment (FIG. 13). In the embodiments shown in FIGS. 18A–18C, the oil flows from the oil pump 450 to the shaft oil hole 441 through the pin oil hole 444 and the oil groove 443. However, such an oil flow is merely opposite of the oil flow in the first to third embodiments described before, and the embodiments in FIGS. 18A–18C serve the same function with the first to third embodiments respectively. Therefore, it can be known that the oil can be supplied to the driving parts, stably. Moreover, without any significant modification, all the variations of the first to third embodiments can be applicable to the inverted type compressor.

It will be apparent to those skilled in the art that various modifications and variations can be made in the crankshaft in a dual capacity compressor of the present invention without departing from the spirit or scope of the invention. Thus, it is intended that the present invention cover the modifications and variations of this invention provided they come within the scope of the appended claims and their equivalents.

INDUSTRIAL APPLICABILITY

As has been explained in respective embodiments, the crankshaft of the present invention has an oil passage(s) that permits the oil to flow from a bottom of the compressor to a top of the crankshaft for both of the rotation directions of the motor, thereby permitting a stable oil supply to driving parts regardless of the motor rotation direction. Application of the crankshaft of the present invention to an dual capacity compressor facilitates prevention of wear of the driving parts and smooth operation of the compressor, such as cooling.

The invention claimed is:

1. A crankshaft in a dual capacity compressor comprising:

a driving shaft inserted in a reversible motor for rotation in a direction the same with the motor together with the motor;

a balance weight on a top end of the driving shaft for prevention of vibration during rotation;

a crank pin on a top surface of the balance weight eccentric from a center of the driving shaft connected to a connecting rod on a piston through an eccentricity adjusting member; and, a regular rotation and reverse rotation oil passage formed along the driving shaft, the balance weight, and the crank pin for individual oil flow both for regular direction rotation and reverse direction rotation of the motor, thereby transmitting a regular direction rotation force or a reverse direction rotation force of the motor to a coupled driving members for compressing refrigerant according to a compression capacity varied with rotation direction, and making a stable oil supply to required driving parts through the regular rotation and reverse rotation oil passage regardless of a motor rotation direction.

2. A crankshaft as claimed in claim 1, wherein the regular rotation and reverse rotation oil passage includes;

a shaft oil hole extended from a bottom end of the driving shaft to a height in a longitudinal direction through an inside of the driving shaft, at least one straight oil groove in communication with the shaft oil hole extended to a length in an outer circumferential surface of the driving shaft, and a pin oil hole in communication with the oil groove extended up to a top part of the crank pin through insides of the balance weight, and the crank pin.

3. A crankshaft as claimed in claim 2, wherein the oil groove is single straight groove for flowing oil regardless of a rotation direction of the motor.

4. A crankshaft as claimed in claim 2, wherein the oil groove includes two straight grooves for flowing oil on the same time regardless of a rotation direction of the motor.

5. A crankshaft as claimed in claim 2, wherein the oil groove is formed in the outer circumferential surface of the driving shaft offset at an angle from an axis of the crank pin in a clockwise or counter clockwise direction.

6. A crankshaft as claimed in claim 2, wherein the oil groove is formed to have a lower end at a height from a lower end of the journal of the driving shaft.

7. A crankshaft as claimed in claim 5, wherein the offset angle is maximum 40°.

8. A crankshaft as claimed in claim 6, wherein the height is minimum 5 mm.

9. A crankshaft as claimed in claim 5, wherein the offset angle optimum for wear suppression of the crankshaft is 22°–33°.

10. A crankshaft as claimed in claim 6, wherein the height optimum for wear suppression of the crankshaft is 10 mm–12 mm.

11. A crankshaft as claimed in claim 5, wherein the offset angle optimum both for wear suppression of the crankshaft and an oil supply rate is 20°–40°.

12. A crankshaft as claimed in claim 6, wherein the height optimum both for wear suppression of the crankshaft and an oil supply rate is 7 mm–15 mm.

13. A crankshaft as claimed in claim 11, wherein the offset angle optimum both for wear suppression of the crankshaft and an oil supply rate is 30±5°.

14. A crankshaft as claimed in claim 12, wherein the height optimum both for wear suppression of the crankshaft and an oil supply rate is 10±2 mm.

15. A crankshaft as claimed in claim 2, wherein the oil groove has a width below 3 mm.

16. A crankshaft as claimed in claim 2, wherein the oil groove has a depth deeper than 2.5 mm.

17. A crankshaft as claimed in claim 2, wherein the oil groove is single straight groove inclusive of a partial helical groove.

18. A crankshaft as claimed in claim 17, wherein the partial helical groove is continuous from an upper part of the straight groove.

19. A crankshaft as claimed in claim 17, wherein the partial helical groove serves for oil supply for a rotation direction in which the crankshaft generates a heavy load.

20. A crankshaft as claimed in claim 17, wherein the oil groove has an upper end and a lower end offset at an angle 10°–30°.

21. A crankshaft as claimed in claim 2, wherein the oil groove further includes at least one supplementary oil groove in a lower part of the journal of the driving shaft for supplying oil to a lower part of a radial bearing.

22. A crankshaft as claimed in claim 21, wherein the supplementary oil groove is in communication with a recessed part in a central part of the journal, and extended to a location in the vicinity of a lower end of the journal.

23. A crankshaft as claimed in claim 21, wherein the supplementary oil groove has a width below 2 mm.

24. A crankshaft as claimed in claim 21, wherein the supplementary oil groove has a lower end located higher than the lower end of the journal of the driving shaft by more than 3 mm.

25. A crankshaft as claimed in claim 21, wherein the supplementary oil groove is offset from the oil groove at an angle greater than 90° on the driving shaft.

26. A crankshaft as claimed in claim 21, wherein the supplementary oil groove is a straight groove.

27. A crankshaft as claimed in claim 21, wherein the supplementary oil groove is a helical groove.

28. A crankshaft as claimed in claim 1, wherein the regular rotation and reverse rotation oil passage includes;

a shaft oil hole extended from a bottom end of the driving shaft to a height in a longitudinal direction through an inside of the driving shaft, at least one helical oil groove in communication with the shaft oil hole extended upward to a length along an outer circumferential surface of the driving shaft, and a pin oil hole in communication with the oil groove extended up to a top part of the crank pin through insides of the balance weight, and the crank pin.

29. A crankshaft as claimed in claim 28, wherein the oil groove includes two helical grooves for independent oil flow for one of rotation directions of the motor.

30. A crankshaft as claimed in claim 29, wherein the helical groove for oil flow during the regular rotation has a length longer than the helical groove for oil flow during the reverse rotation.

31. A crankshaft as claimed in claim 28, wherein the oil groove includes a helical groove for oil flow during one of rotation directions of the motor, and a straight groove for oil flow regardless of the rotation directions of the motor.

32. A crankshaft as claimed in claim 31, wherein the helical groove serves for oil flow for a rotation direction in which the crankshaft generates a great load.

33. A crankshaft as claimed in claim 29 or 31, wherein the oil grooves do not cross in the outer circumferential surface of the driving shaft.

34. A crankshaft as claimed in claim 29, or 31, wherein the oil grooves are not connected at upper ends thereof to each other.

35. A crankshaft as claimed in one of claims 4, 29, and 31, wherein the pin oil hole includes one common hole connected to the two oil grooves, or two independent holes connected to two oil grooves, individually.

36. A crankshaft as claimed in one of claims 4, 29, and 31, wherein the shaft oil hole includes one common hole connected to the two oil grooves, or two independent holes connected to two oil grooves, individually.

37. A crankshaft as claimed in claim 1, wherein the regular rotation and reverse rotation oil passage includes;

at least one shaft oil hole extended from a bottom end of the driving shaft to a location in the vicinity of the crank pin in a longitudinal direction through an inside of the driving shaft, a pin oil hole directly connected to the pin oil hole, and extended from a top end of the shaft oil hole up to a top part of the crank pin through insides of the balance weight, and the crank pin, and at least one oil groove in communication with the shaft oil hole, or the pin oil hole, and extended upward in an outer circumferential surface of the driving shaft.

38. A crankshaft as claimed in claim 37, wherein the shaft oil hole includes an eccentric hole with respect to an axis of the driving shaft.

39. A crankshaft as claimed in claim 37, wherein the shaft oil hole includes two eccentric holes with respect to the axis of the driving shaft.

40. A crankshaft as claimed in claim 37, wherein the shaft oil hole includes a coaxial hole with respect to an axis of the driving shaft.

41. A crankshaft as claimed in claim 37, wherein the oil groove is single helical groove.

42. A crankshaft as claimed in claim 41, wherein the single helical groove includes an upper end and a lower end connected to the shaft oil hole, respectively.

43. A crankshaft as claimed in claim 41, wherein the single helical groove includes an upper end and a lower end not aligned on the same straight line.

44. A crankshaft as claimed in claim 41, wherein the single helical groove serves for oil flow for a rotation direction the crankshaft generates a great load.

45. A crankshaft as claimed in claim 37, wherein the oil groove includes two helical grooves extended in opposite directions.

46. A crankshaft as claimed in claim 45, wherein each of the helical grooves includes a lower end connected with the shaft oil hole, and an upper end closed to the shaft oil hole.

47. A crankshaft as claimed in claim 46, wherein the helical grooves include upper ends and lower ends connected to each other, respectively.

48. A crankshaft as claimed in claim 45, wherein the helical grooves do not cross each other in the outer circumferential surface of the driving shaft.

49. A crankshaft as claimed in claim 37, wherein the oil groove includes one or two straight grooves for oil flow regardless of the rotation direction of the motor.

50. A crankshaft as claimed in claim 49, wherein each of the straight grooves includes a lower end connected to the shaft oil hole, and an upper end closed to the shaft oil hole.

51. A crankshaft as claimed in claim 37, wherein the pin oil hole includes a single common hole or two independent holes.

52. A crankshaft in a dual capacity compressor comprising:

a driving shaft inserted in a reversible motor for rotation in a direction the same with the motor together with the motor;

a balance weight on a top end of the driving shaft for prevention of vibration during rotation;

a crank pin on a top surface of the balance weight eccentric from a center of the driving shaft connected to a connecting rod on a piston through an eccentricity adjusting member; and, a regular rotation and reverse rotation oil passage for individual oil flow for a regular direction rotation and a reverse direction rotation of the motor, including;

a shaft oil hole extended from a bottom end of the driving shaft to a height in a longitudinal direction through an inside of the driving shaft, one straight oil groove in communication with the shaft oil hole extended to a length in an outer circumferential surface of the driving shaft for oil flow regardless of the rotation direction of the motor, and a pin oil hole in communication with the oil groove extended up to a top part of the crank pin through insides of the balance weight, and the crank pin, thereby transmitting a regular direction rotation force or a reverse direction rotation force of the motor to a coupled driving members for compressing refrigerant according to a compression capacity varied with rotation direction, and making a stable oil supply to required driving parts through the regular rotation and reverse rotation oil passage regardless of a motor rotation direction.

53. A crankshaft as claimed in claim 52, wherein the oil groove is formed in the outer circumferential surface of the driving shaft offset at an angle from an axis of the crank pin in a clockwise or counter clockwise direction.

54. A crankshaft as claimed in claim 52, wherein the oil groove is formed to have a lower end at a height from a lower end of the journal of the driving shaft.

55. A crankshaft as claimed in claim 53, wherein the offset angle is maximum 40°.

56. A crankshaft as claimed in claim 54, wherein the height is minimum 5 mm.

57. A crankshaft as claimed in claim 53, wherein the offset angle optimum for wear suppression of the crankshaft is 22°–33°.

58. A crankshaft as claimed in claim 54, wherein the height optimum for wear suppression of the crankshaft is 10 mm–12 mm.

59. A crankshaft as claimed in claim 53, wherein the offset angle optimum both for wear suppression of the crankshaft and an oil supply rate is 20°–40°.

60. A crankshaft as claimed in claim 54, wherein the height optimum both for wear suppression of the crankshaft and an oil supply rate is 7 mm–15 mm.

61. A crankshaft as claimed in claim 59, wherein the offset angle optimum both for wear suppression of the crankshaft and an oil supply rate is 30±5°.

62. A crankshaft as claimed in claim 60, wherein the height optimum both for wear suppression of the crankshaft and an oil supply rate is 10±2 mm.

63. A crankshaft as claimed in claim 52, wherein the oil groove has a width below 3 mm.

64. A crankshaft as claimed in claim 52, wherein the oil groove has a depth deeper than 2.5 mm.

65. A crankshaft as claimed in claim 52, wherein the oil groove is single straight groove inclusive of a partial helical groove.

66. A crankshaft as claimed in claim 65, wherein the partial helical groove is continuous from an upper part of the straight groove.

67. A crankshaft as claimed in claim 65, wherein the partial helical groove serves for oil supply for a rotation direction in which the crankshaft generates a heavy load.

68. A crankshaft as claimed in claim 65, wherein the oil groove has an upper end and a lower end offset at an angle 10°–30°.

69. A crankshaft as claimed in claim 52, wherein the oil groove further includes at least one supplementary oil groove in a lower part of the journal of the driving shaft for supplying oil to a lower part of a radial bearing.

70. A crankshaft as claimed in claim 69, wherein the supplementary oil groove is in communication with a recessed part in a central part of the journal, and extended to a location in the vicinity of a lower end of the journal.

71. A crankshaft as claimed in claim 69, wherein the supplementary oil groove has a width below 2 mm.

72. A crankshaft as claimed in claim 69, wherein the supplementary oil groove has a lower end located higher than the lower end of the journal of the driving shaft by more than 3 mm.

73. A crankshaft as claimed in claim 69, wherein the supplementary oil groove is offset from the oil groove at an angle greater than 90° on the driving shaft.

74. A crankshaft as claimed in claim 69, wherein the supplementary oil groove is a straight groove.

75. A crankshaft as claimed in claim 69, wherein the supplementary oil groove is a helical groove.

* * * * *